US005163392A

United States Patent [19]

Morishima et al.

[11] Patent Number: 5,163,392

[45] Date of Patent: Nov. 17, 1992

[54] SPIRAL SPRING TYPE STARTER APPARATUS FOR AN INTERNAL COMBUSTION ENGINE

[75] Inventors: Ryuji Morishima; Katsutoshi Asai; Ryutaro Fukumoto, all of Nagoya, Japan

[73] Assignee: Mitsubishi Jukogyo Kabushiki Kaisha, Tokyo, Japan

[21] Appl. No.: 683,171

[22] Filed: Apr. 9, 1991

Related U.S. Application Data

[62] Division of Ser. No. 458,374, Dec. 28, 1989, Pat. No. 5,083,534.

[30] Foreign Application Priority Data

Apr. 5, 1989 [JP] Japan ..... 1-84708
Oct. 25, 1989 [JP] Japan ..... 1-123981[U]

[51] Int. Cl.[5] ..... F02N 5/02
[52] U.S. Cl. ..... 123/179.25; 123/185.14
[58] Field of Search ..... 123/179 S, 179 SE, 179 M, 123/179 R

[56] References Cited

U.S. PATENT DOCUMENTS 3,139,877 7/1964 Graybill ..... 123/179 S
3,395,687 8/1968 Harkness ..... 123/179 S
3,861,374 1/1975 Dooley et al. ..... 123/179 S

FOREIGN PATENT DOCUMENTS 56-24309 6/1981 Japan .
58-51271 3/1983 Japan .
63-19073 2/1988 Japan .
63-28878 2/1988 Japan .
63-110672 7/1988 Japan .
1-190965 8/1989 Japan ..... 123/179 R

*Primary Examiner*—Andrew M. Dolinar
*Attorney, Agent, or Firm*—Wenderoth, Lind & Ponack

[57] ABSTRACT

A spiral spring type starter apparatus for an internal combustion engine is disclosed. The apparatus includes a power accumulator mechanism having a spiral spring with its one end fixed to a starter shaft and its other end fixed to a power accumulator box, a ratchet device provided respectively on the starter shaft side and on the power accumulator box side of the power accumulator mechanism for maintaining a power accumulated condition in the spiral spring and also for enabling power to be input to the power accumulator box and power to be output from the starter shaft, a centrifugal type ratchet mechanism interposed between the starter shaft and a crank shaft of the engine, a motor adapted to be fed with electric power from a generator through a control circuit after starting of the engine, and a power transmission device for transmitting output power from the motor to the power accumulator box. The motor and battery can be reduced in size. The electric control circuit for operation and stoppage of the motor for driving the spring power accumulating chamber is simple, and assembly of the starter is easy.

9 Claims, 27 Drawing Sheets

SPIRAL SPRING TYPE STARTER APPARATUS FOR AN INTERNAL COMBUSTION ENGINE

This application is a divisional application of Ser. No. 07/458,374, filed Dec. 28, 1989 now U.S. Pat. No. 5,083,534.

BACKGROUND OF THE INVENTION

2. Field of the Invention

The present invention relates to a labor-saving type starter apparatus for an engine not provided with an automatic starter apparatus such as a cell starter.

2. Description of the Prior Art

As a labor-saving type starter apparatus to replace for a reel type starting system for a small-sized internal combustion engine, a starter apparatus making use of a leaf spring of spiral shape as an energy accumulator has been disclosed in Laid-Open Japanese Patent Specification No. 58-51271 (1983).

The invention according to this patent application relates to a starter apparatus which can automatically start an engine through a starting operation of merely pulling a rod 116 by making use of an unnecessary torque upon stoppage of the engine in order to accumulate energy for starting as shown in FIGS. 33 and 34. The above-referred starter apparatus in the prior art illustrated in these figures is provided with a ratchet box 113 mounted on a baffle plate, supporting a starter shaft 107 concentric with a crank shaft 101 and accommodating therewithin a ratchet device for preventing the same starter shaft 107 from rotating in the reverse direction to the crank shaft 101. A power accumulator box 114 is rotatably supported from said starter shaft 107 and provided therein with a spiral spring 115 having its one end fixed to the same starter shaft 107 and the other end fixed to a circumferential wall. A starter pulley 102 fixed to the crank shaft 101 is and provided with a pin for supporting a claw 110 adapted to be engaged with and disengaged from a winding ratchet wheel 111 and a spring 110*a* for engaging the same claw 110 with the winding ratchet wheel 111 at the time of low speed rotation. A ratchet plate 109 is supported by the same starter pulley 102 so as to be displaceable in the circumferential direction with respect to the starter pulley 102 owing to an elongated hole in which the pin of the starter pulley 102 is inserted for disengaging the above-mentioned claw 110 from the winding ratchet wheel 111 by their relative displacement. A starter rod 116 is inserted into a hole formed in the above-mentioned power accumulator box 114 from the side of the above-described baffle plate for fixing the aforementioned power accumulator box 114, and a claw 106 of the power accumulator box 114 is provided in the aforementioned power accumulator box 114 and is adapted to be engaged with the above-mentioned ratchet plate 109 and starter pulley 102 as a result of rotation of the same power accumulator box 114. At the time of low speed rotation upon stoppage of the engine, by the claw 110 engaged with the winding ratchet wheel 111, the above-mentioned starter shaft 107 is interlocked with the aforementioned starter pulley 102. Thus power is accumulated by winding the spiral spring 115 in the power accumulator box 114 which is locked by the starter rod 116, but upon starting of the engine the aforementioned starter rod 116 is disengaged from the power accumulator box 114. Thus, the power accumulator box 114 is rotated by the power accumulated in the spiral spring 115 and is are successively interlocked with the aforementioned ratchet plate 109 and starter pulley 102 by means of the claw of the power accumulator box 114, and the coupling between the above-mentioned starter pulley 102 and the aforementioned starter shaft 107 is blocked by the ratchet plate 109 so that the engine may be started by the rotation of the above-mentioned starter pulley 102.

According to the prior art as described above, since an inertial force upon stoppage of an engine is employed as an energy source for driving a power accumulator mechanism, in the general process of stopping an engine after an idling operation, shortage of energy will occur. In order to accumulate energy required for starting, the operation of raising a rotational speed of the engine before stoppage or the like is necessary. Therefore, the prior art apparatus is impractical to use.

In addition, in the event that one has failed in starting an engine by means of the above-described spiral spring type starter apparatus, as a power source for accumulating power in the power accumulator spring either an external electric power source or human labor is necessitated. Therefore, the apparatus is not always satisfactory as a labor-saving type starter apparatus.

SUMMARY OF THE INVENTION

It is accordingly one object of the present invention to provide a labor-saving starter apparatus which has resolved the problems in the prior art as described above, in which increase of a weight of an engine caused by loading of a battery in the cell starter system is prevented, and which does not require a large drawing force upon starting as necessitated in the case of the reel type starter system, and so is adapted even for a person having little physical strength.

Another object of the present invention is to provide a labor-saving type starter apparatus which can achieve starting a plurality of times and which can minimize a waiting time before restarting.

Still another object of the present invention is to provide a labor-saving type starter apparatus in which an associated device for starting is very light in weight even when it includes an electric power source section, and which is sufficiently light even in comparison with a cell starter type apparatus.

A further object of the present invention is to provide a labor-saving type starter apparatus which can stably accumulate energy in an accumulator spring, and hence can always provide stable output power and excellent starting performance.

Yet another object of the present invention is to provide a labor-saving type starter apparatus which is easy to assemble and compact in structure.

According to one feature of the present invention, there is provided a spiral spring type starter apparatus for an internal combustion engine comprising power accumulator means including a spiral spring having its one end fixed to a starter shaft and the other end fixed to a power accumulator box, ratchet means provided respectively on the starter shaft side and on the power accumulator box side of the power accumulator means for maintaining a power accumulated condition in the aforementioned spring and also enabling power input to the power accumulator box and power output from the above-mentioned starter shaft, a centrifugal type ratchet mechanism interposed between the aforementioned starter shaft and a crank shaft of the engine, a motor adapted to be fed with electric power from a generator through a control circuit after starting of the engine, and power transmission means for transmitting output power from the same motor to the aforementioned power accumulator box.

According to the present invention, owing to the above-mentioned structural feature, a D.C. power supply is provided by rectifying electric power of a rotating magnetic pole type generator for feeding ignition energy to thereby drive a motor. After an output torque of this motor has been enhanced via reduction gears, energy accumulation is effected by driving an energy accumulator mechanism comprising a spiral spring consisting of a leaf spring and a twisting mechanism to be used as an energy source for driving of a crank shaft at the next starting. Drive of the motor is effected by applying a D.C. voltage for a predetermined period by means of a power supply which begins to operate after the engine is started and an output voltage of a rectifier circuit has reached on exceeded a predetermined value. Additionally, a control circuit is provided and includes a timer element.

According to another feature of the present invention, there is provided a spiral spring type starter apparatus for a general purpose gasoline engine including a rotatary magnetic pole type generator and an ignition timing control circuit. The starter apparatus comprises a charging circuit provided in parallel with the ignition timing control circuit, a storage battery for accumulating electric power fed from the charging circuit, a D.C. motor driven by electric power accumulated in the storage battery, a control unit for controlling operation and stoppage of the D.C. motor, a high reduction ratio speed reduction mechanism for transmitting mechanical power of the D.C. motor, a spiral spring type power accumulator device for accumulating mechanical energy upon receiving a torque exerted by the aforementioned speed reduction mechanism, and a one-way type power transmission element for transmitting energy accumulated in the above-mentioned spiral spring to a crank shaft.

According to the present invention, owing to the last-mentioned structural feature, by selecting the reduction ratio of the high reduction ratio speed reduction mechanism at $$\frac{1}{250} - \frac{1}{300},$$

a motor capacity as well as a battery capacity can be reduced by a factor of $_{10}{}^{1}$ and $_{6}{}^{1}$, respectively, as compared to the cell starter system. In this manner practical usefulness is not lost even though a storage battery is provided. Also by charging the storage battery during operation of the engine by means of a generator for use as an ignition power supply, an energy source for starting the engine a plurality of times can be insured and at the same time useless energy generated in an ignition circuit can be absorbed. Furthermore, by controlling a starting operation and an operation of an energy accumulator spring drive motor jointly, an energy accumulating operation of the energy accumulator spring can be effected automatically by one starting operation and the a waiting time before restarting can be shortened.

According to still another feature of the present invention, there is provided a spiral spring type starter apparatus for an internal combustion engine, composed of a spiral spring power accumulator device consisting of a shaft, a casing rotatably supported about the shaft and a spiral spring having its opposite ends fixedly secured to the shaft and the casing, respectively, a ratchet mechanism for controlling rotation and stoppage of the shaft, and a drive power source consisting of a motor for rotationally driving the casing and a speed reduction mechanism. The apparatus comprises a converter mechanism for converting a particular rotational angle of the casing into one revolution by means of a gear rotating integrally with the casing and another gear meshed with the above-mentioned gear, a cam and a rotary ON-OFF contact provided on an output shaft of the above-described converter mechanism so as to be rotatable integrally with the aforementioned shaft, and a manual ON-OFF switch. By operating the manual ON-OFF switch, after starting of the engine, energy accumulation in the above-mentioned power accumulator device can be effected automatically and the starter apparatus is placed in a standby state.

According to the present invention, owing to the just-mentioned structural feature, as a result of the provision of the one revolution converter mechanism, an electric control circuit, provided for operation and stoppage of a motor serving as a driving power source for a spring power accumulating chamber becomes simple. Since an operation of a starting ratchet lever can be carried out by making use of the above-mentioned motor in common, a remote-control operation for starting the engine becomes possible. Moreover, since completion of winding of a spiral spring is detected by a number of winding revolutions, a stable output of a spiral spring can always be obtained, and hence a starting performance can be improved.

According to yet another feature of the present invention, there is provided, within a casing of the internal combustion engine a spiral spring type starter apparatus for an internal combustion engine, having a spring power accumulating chamber in which an inner end of a spiral spring is fixed to a starter shaft and its outer end is fixed to a casing, a motor for rotating a casing of the above-mentioned spring power accumulating chamber via a high reduction ratio speed reduction mechanism, and a magnet wheel assembly for transmitting a torque of the starter shaft of the above-mentioned spring power accumulating chamber to a crank shaft. The apparatus comprises a plate perpendicularly intersecting the axis of the crank shaft and disposed within the above-mentioned case, and a bearing rotatably supported by the aforementioned plate and projected from the abovedescribed casing for rotatably supporting the starter shaft. The above-mentioned motor and high reduction ratio speed reduction mechanism are fixedly supported by the above-mentioned plate.

According to the present invention, owing to the last-mentioned structural feature, by providing all the bearings and spigot joint sections on the plate, the spiral spring type power accumulator device, the ratchet mechanism and the driving power source can be all mounted on the same plate. Therefore, assembly of the apparatus can be made easy.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIG. 29(*b*) is a transverse cross-section view taken along line A—A in FIG. 29(*a*);

DESCRIPTION OF THE PREFERRED EMBODIMENTS

Figure 1:
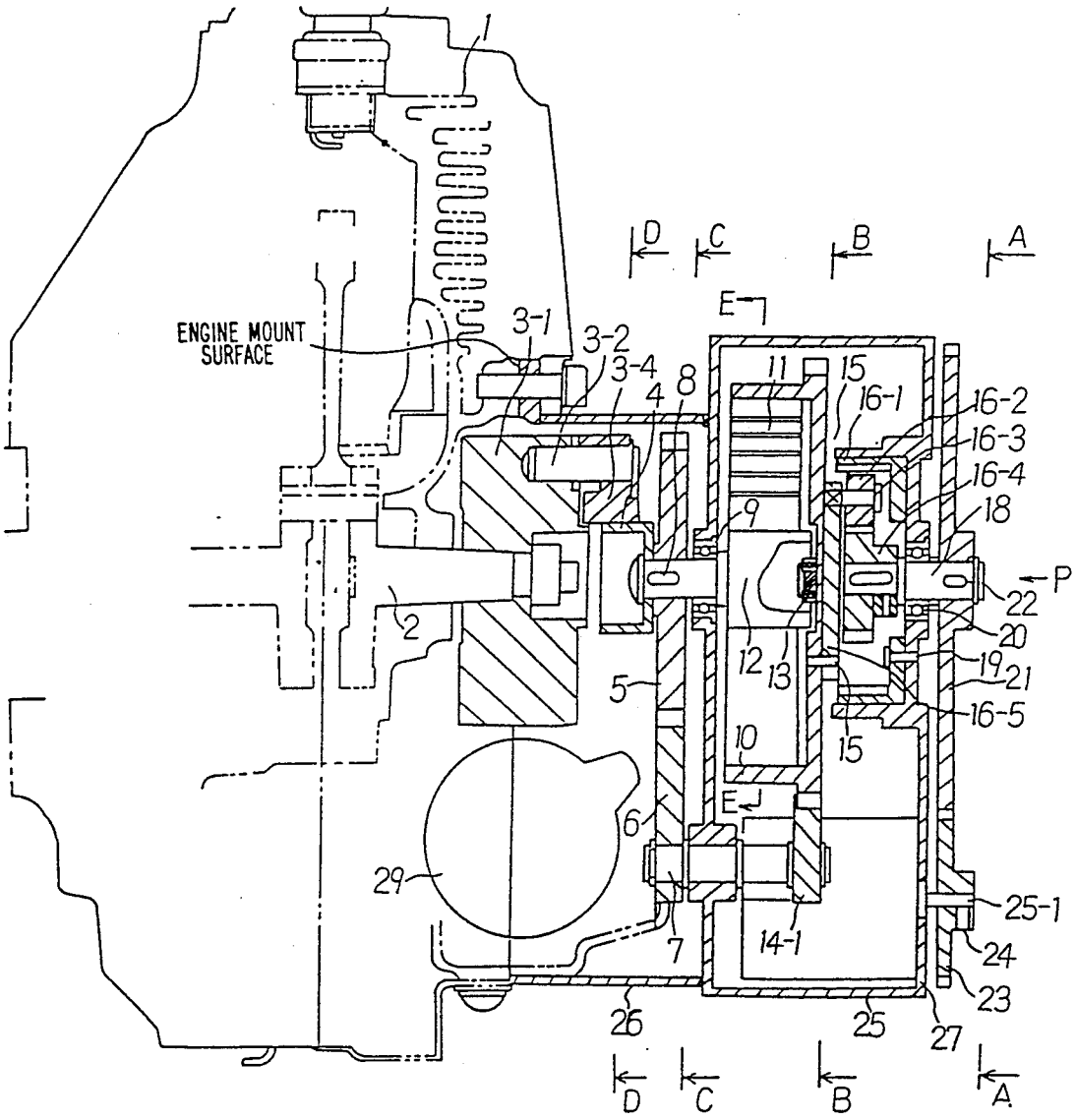
FIG. 1 is a general cross-section view showing one preferred embodiment of the present invention.
Figure 2:
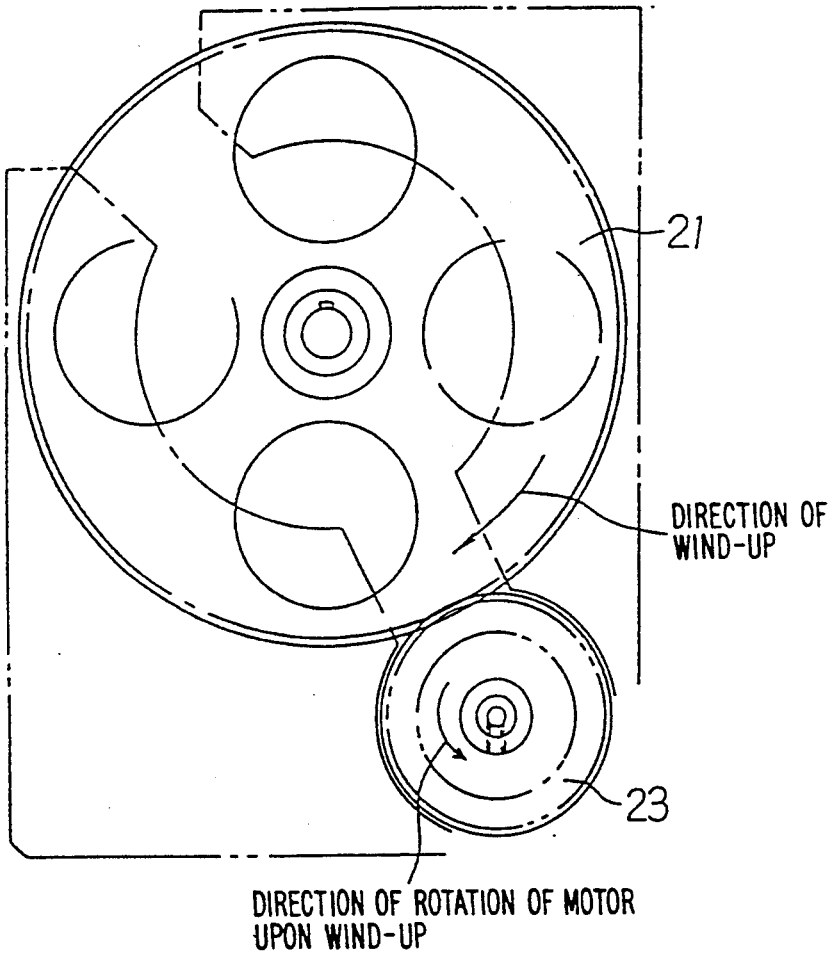
FIG. 2 is a transverse cross-section view taken along line A—A in FIG. 1, which shows a drive source for a power accumulating spring.

Now a first preferred embodiment of the present invention will be described with reference to FIGS. 1 through 8.

In FIGS. 1 to 7, reference numeral 1 designates an engine, numeral 2 designates a crank shaft, numeral 3 designates a generator rotary magnetic pole assembly, numeral 3-1 designates a rotary magnetic pole, numeral 3-2 designates a pin, numeral 3-3 designates a spring, numeral 3-4 designates a starter claw, numeral 3-5 designates a whirl-stop pin, numeral 4 designates a starter ratchet wheel, numeral 5 designates a starting ratchet wheel, numeral 6 designates a starting ratchet, numeral 7 designates a shaft, numeral 8 designates a whirl-stop key, numeral 9 designates a ball bearing, numeral 10 designates a spring power accumulating chamber, numeral 11 designates a power accumulating spring, numeral 12 designates a starter shaft, numeral 13 designates a ball bearing, numeral 14 designates a ratchet claw assembly, numeral 15 designates a set screw, numeral 16 designates planetary speed reduction gears, numeral 16-1 designates an inner gear, numeral 16-2 designates a planet gear, numeral 16-3 designates a planet gear shaft, numeral 16-4 designates a sun gear, numeral 16-5 designates an output shaft, numeral 17 designates a key, numeral 18 designates a shaft of a speed reduction mechanism, numeral 19 designates a set screw, numeral 20 designates a ball bearing, numeral 21 designates a larger gear, numeral 22 designates a key, numeral 23 designates a smaller gear, numeral 24 designates a bolt, numeral 25 designates a D.C. motor, numeral 25-1 designates a shaft of the D.C. motor, numeral 26 designates frame-A, numeral 27 designates frame-B, numeral 14-1 designates a ratchet claw, numeral 14-2 designates a pin, numeral 14-3 designates another pin, numeral 14-4 designates a spring, numeral 29 designates an armature assembly, numeral 30 designates a generator, numeral 31 designates a D.C. constant voltage power supply and a control device, numeral 32 designates an IC element, numeral 33 designates an emergency battery, numeral 34 designates a switch, numeral 35 designates a projected portion of the starter ratchet wheel, numeral 36 designates a toothed portion of the spring power accumulating chamber 10, and numeral 37 designates a recessed portion of the starting ratchet wheel 5.

In FIG. 1, component parts forming the starter apparatus are assembled within the frame-A 26 and the frame-B 27, and they are mounted to the engine 1 via the frame-A 26.

To the frame-B 27 are mounted the D.C. motor 25 serving as a drive source for the power accumulating spring 11, speed reduction gears 23 and 21, the planetary speed reduction gears 16 having a high reduction ratio, the shaft 18 and the ball bearing 20. These drive the spring power accumulating chamber 10 fixed to the output shaft 16-5 forming one component part of the above-mentioned planetary speed reduction gears 16.

The spring power accumulating chamber 10 is pivotably supported via the frame-A 26 and the ball bearing 9, and by the intermediary of the supporting system consisting of the shaft 12, the ball bearing 13 positioned on the side facing to the spring power accumulating chamber 10 of the shaft 12 and provided at the center of rotation of the shaft 12, and the above-mentioned planetary speed reduction gears 16.

Figure 5:
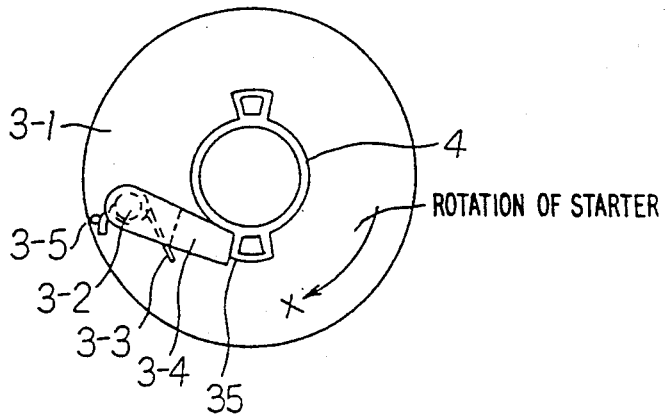
FIG. 5 is a transverse cross-section view taken along line D—D in FIG. 1, which shows a drive control mechanism for a starter ratchet wheel.

On the engine side of the shaft 12 are mounted the starting ratchet wheel 5 fixed by the whirl-stop key 8 and the starter ratchet wheel 4. The starting ratchet wheel 5 is prevented from rotating by the starting ratchet 6. As shown in FIG. 5, the starter ratchet wheel 4 is engaged at its projected portion 35 with the starter claw 3-4 provided in the generator rotary magnetic pole assembly 3.

Figure 3:
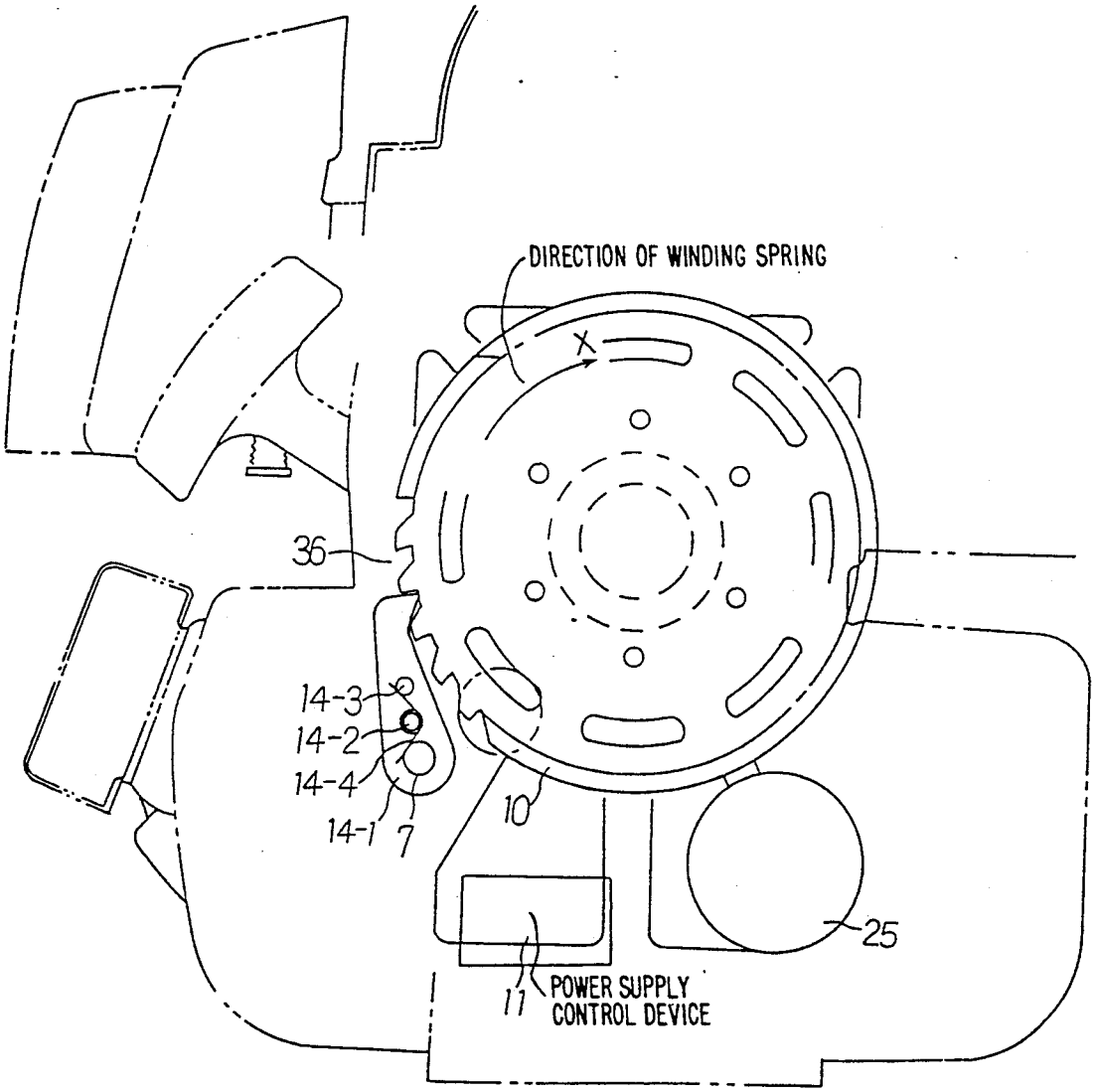
FIG. 3 is a transverse cross-section view taken along line B—B in FIG. 1, which shows a drive control mechanism for a spring power accumulating chamber.

Rotation control for the spring power accumulating chamber 10 is effected by engagement of the ratchet claw 14-1 forming a component part of the ratchet assembly 14 with the toothed portion 36 provided at the outer circumferential portion of the spring power accumulating chamber 10 shown in FIG. 3.

Figure 4:
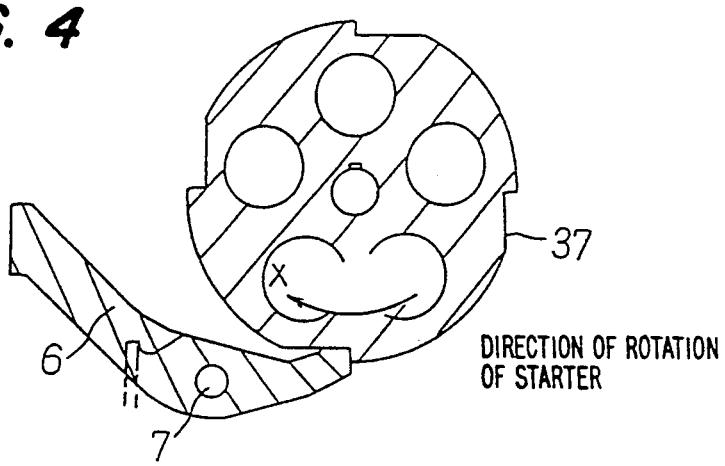
FIG. 4 is a transverse cross-section view taken along line C—C in FIG. 1, which shows a drive control mechanism for a starting ratchet wheel.

Under an engaged condition of the starting ratchet wheel 5 with the starting ratchet 6, as shown in FIG. 4, the recessed portion 37 provided on the outer circumference of the starting ratchet wheel 5 is meshed with the ratchet 6, and if the engagement with the ratchet 6 is released, the ratchet wheel 5 becomes free to rotate.

Figure 6:
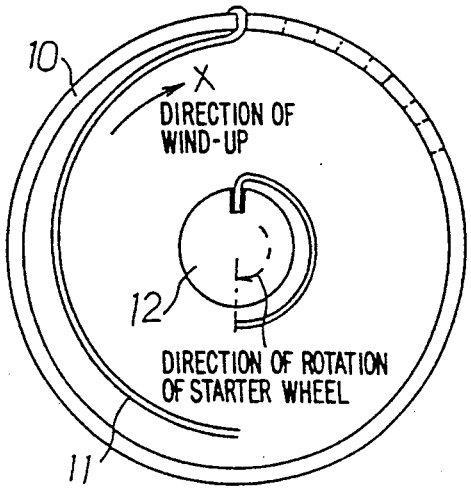
FIG. 6 is a transverse cross-section view taken along line E—E in FIG. 1, which shows shapes of end portions of a power accumulating spring.

The opposite ends of the leaf shaped power accumulating spring 11 are fixed by grooves formed in the circumferential wall of the spring power accumulating chamber 10 and in the shaft 12, as shown in FIG. 6.

Now, if rotation of the starting ratchet wheel 5 is locked by the starting ratchet 6 as shown in FIG. 4 and the spring power accumulating chamber 10 is rotated in the clockwise direction as viewed in FIG. 6 (in the direction of arrow X indicated in the figure), then the leaf spring is wound up around the shaft 12 and power is accumulated therein.

However, under the power accumulating condition, when the torque in the direction X exerted upon the power accumulating chamber 10 has disappeared, rotation in the counter-clockwise direction of the power accumulating chamber 10, caused by a rewinding torque exerted by the leaf spring 11, is prevented by the ratchet mechanism shown in FIG. 3.

Under this power accumulating condition, if the lock for the starting ratchet wheel 5 is released by pushing the starting ratchet 6 (See FIG. 4), then the shaft 12 rotates in the direction of the leaf spring 11 having been wound up. Hence, the crank shaft 2 is rotated in the winding direction of the leaf spring 11 (in the clockwise direction as viewed in the direction of arrow P in FIG. 1) by the starter claw 3-4 of the generator rotary magnet pole assembly 3 engaged with the projected portion of the starter ratchet wheel 4 shown in FIG. 5, and thereby the engine 1 is started.

At this time, if an elastic driving torque for the leaf spring 11 in the power accumulating chamber 10 is applied by the D.C. motor 25 via the speed reduction gears 23 and 21 and the planetary gears 16, the power for starting the engine 1 can be obtained. After the engine 1 has started, the starter claw 3-4 is released from contact with the starter ratchet wheel 4 due to a centrifugal force.

Figure 7:
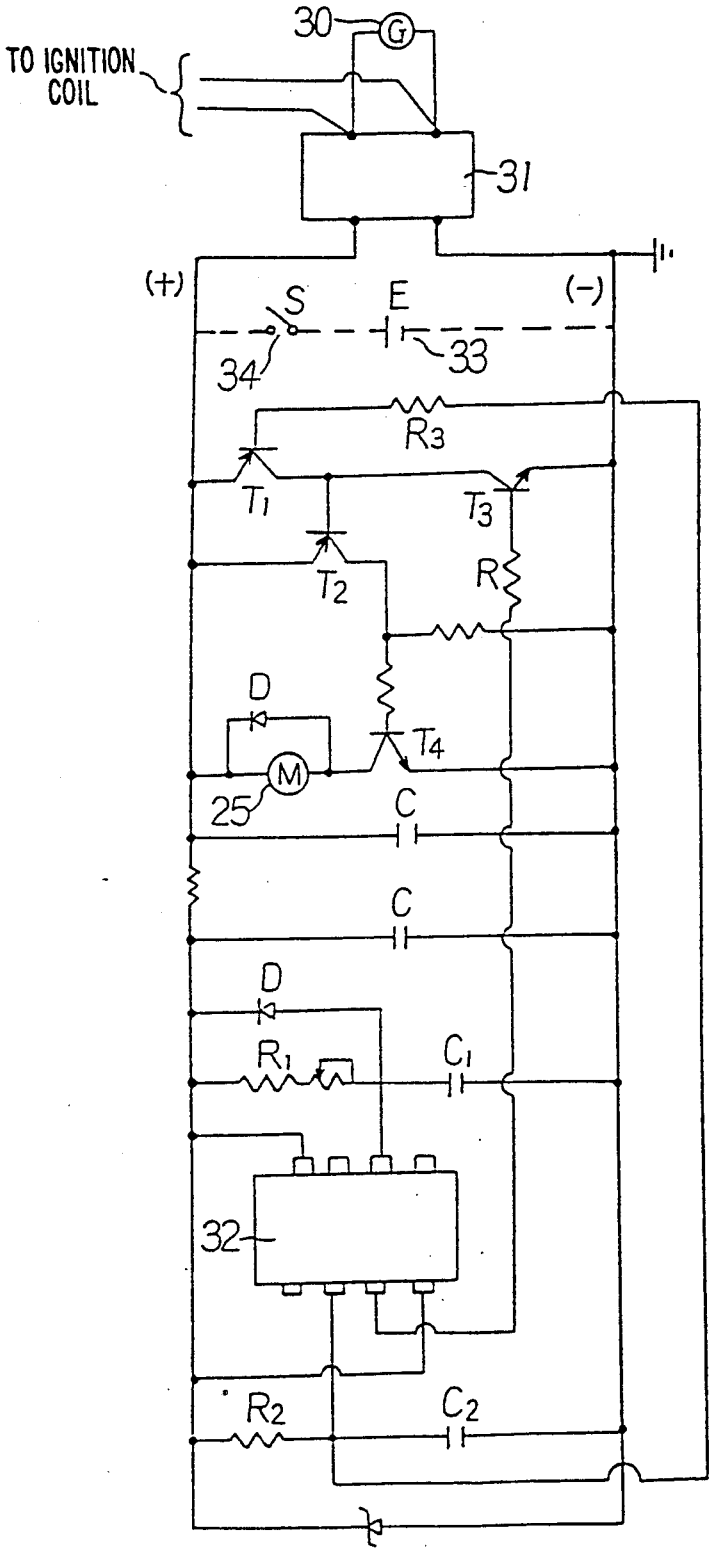
FIG. 7 shows a control circuit of a D.C. motor for use with a power accumulating spring.
Figure 8A:
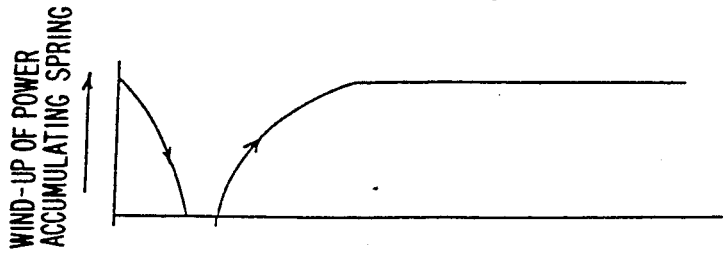
FIGS. 8(*a*)-8(*d*) show timing charts upon starting of an engine.
Figure 8B:
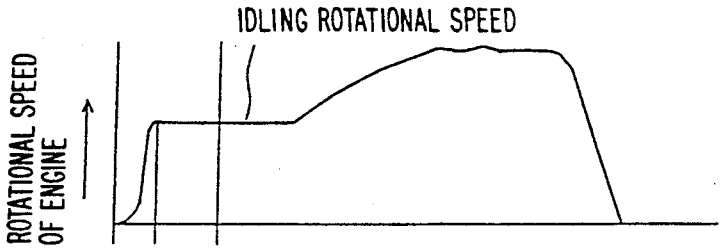
Figure 8C:
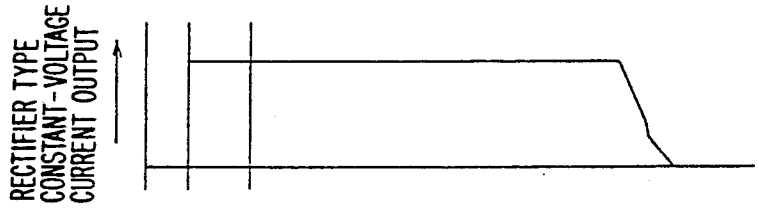
Figure 8D:
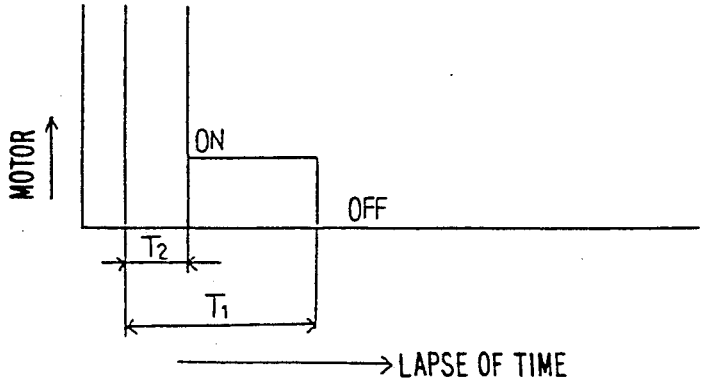

In FIGS. 7 and 8 are shown a motor driving circuit and a control timing chart, respectively. An A.C. output of the generator 30 is used in common with an ignition circuit as a primary power supply for a D.C. constant voltage power supply 31. This D.C. constant power supply 31 outputs a constant D.C. voltage when the engine was started and has reached, for instance, an idling rotational speed or higher. A secondary side circuit for performing motor drive and control is constructed in a compact form by means of an IC element 32, transistors $T_r$, diodes D, resistors R and capacitors C.

The motor 25 is fed with electric power only during the period of from time $T_2$ to time $T_1$ in FIG. 8 by means of a timer circuit having time constants $T_1$ and $T_2$ respectively determined by $T_1 = R_1C_1$ and $$T_2 = \frac{R_2R_3}{R_2 + R_3} C_2.$$

More particularly, after the engine 1 has been started and has reached an idling rotational speed or higher, the starter claw 3-4 of the rotary magnet pole assembly 3 of the generator 30 is disengaged from the starter ratchet wheel 4 due to a centrifugal force. Hence the D.C. constant voltage power supply 31 begins to output a constant D.C. voltage. Then after a period $T_2$ the motor 25 begins to be supplied with electric power, and it accumulates energy by winding the power accumulating spring 11 until time $T_1$. After time $T_1$, electric power supply to the motor 25 is interrupted, and the motor 25 becomes unloaded, but rewinding of the power accumulating spring 11 is prevented by engagement of the toothed portion 36 of the spring power accumulating chamber 10 with the ratchet claw 14-1, and thereby the power accumulated condition is maintained. The above-described winding operation for the power accumulating spring 11 is carried out within an extremely short period of time, and it is completed during an idling operation after starting of the engine.

Thereafter, the engine is operated at a desired rotational speed by opening a throttle valve and the output voltage of the generator 30 becomes higher, but the D.C. stabilized power supply 31 continues to output a constant voltage and protects the control circuit.

The timing of the above-described operation is shown by diagrams in FIG. 8. It are to be noted that a battery E 33 and a switch, respectively, S 34 in FIG. 7 is an external D.C. power supply and a switch to be used when the power accumulating operation has failed or when the illustrated power accumulating device is initially operated.

Accordingly, the above-described preferred embodiment of the present invention can provide various advantages due to the provision of a generator driven by an engine, a motor driven by the above-mentioned generator and an energy accumulating mechanism driven by the aforementioned motor. Drive for the above-mentioned energy accumulating mechanism is effected during operation of the engine and energy required for starting the engine can be reliably accumulated. As a result of the provision of a power supply control circuit for an energy accumulating mechanism drive motor, control for a drive section can be automatically effected electrically, Thus, there is no need for manual operation of the engine. Moreover, since a cell motor is not used, a battery for use in starting is unnecessary, and so, the starter apparatus is light in weight and compact in structure.

Figure 9:
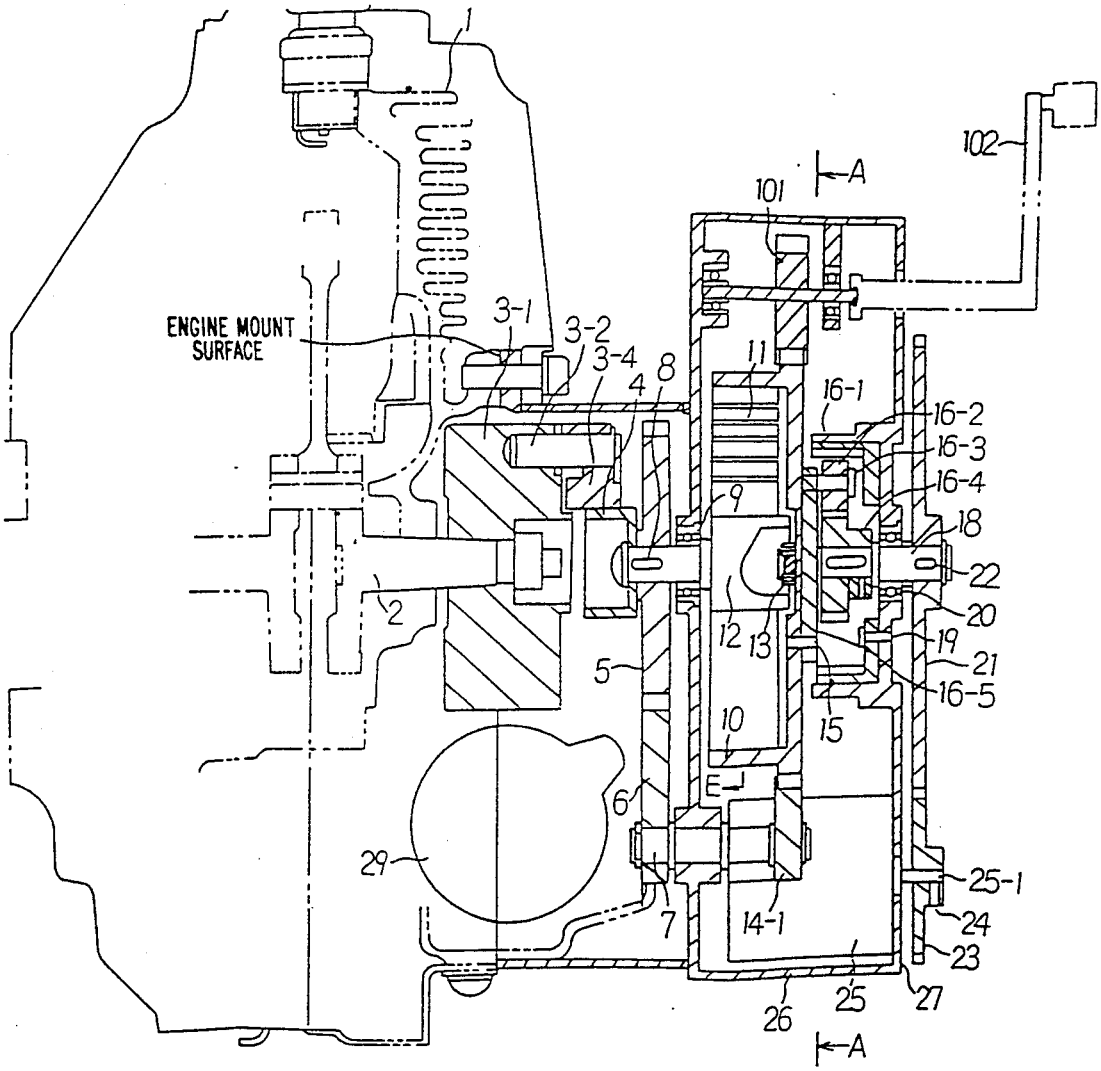
FIG. 9 is a longitudinal cross-section view showing a modified embodiment of the present invention provided with a hand operating crank.
Figure 10:
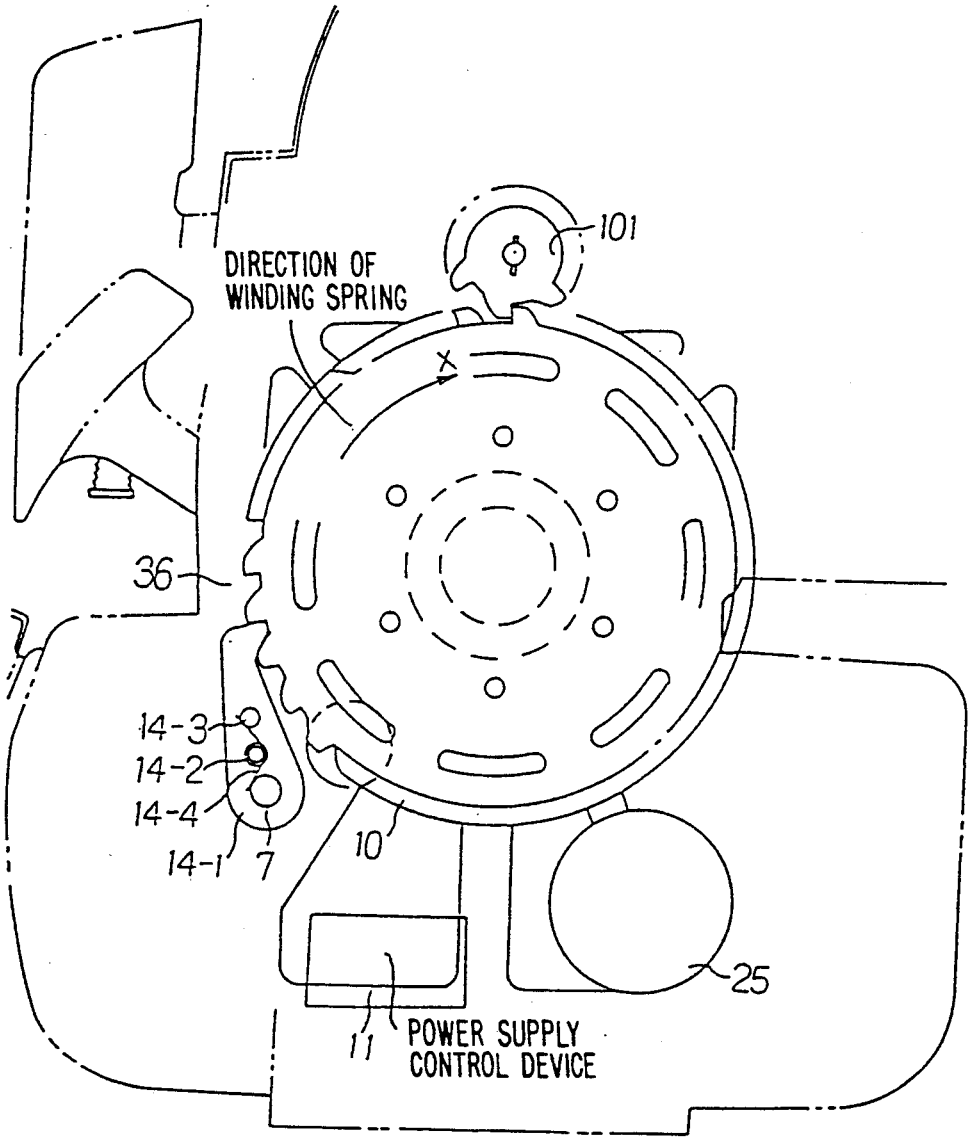
FIG. 10 is a transverse cross-section view taken along line A—A in FIG. 9.
Figure 11:
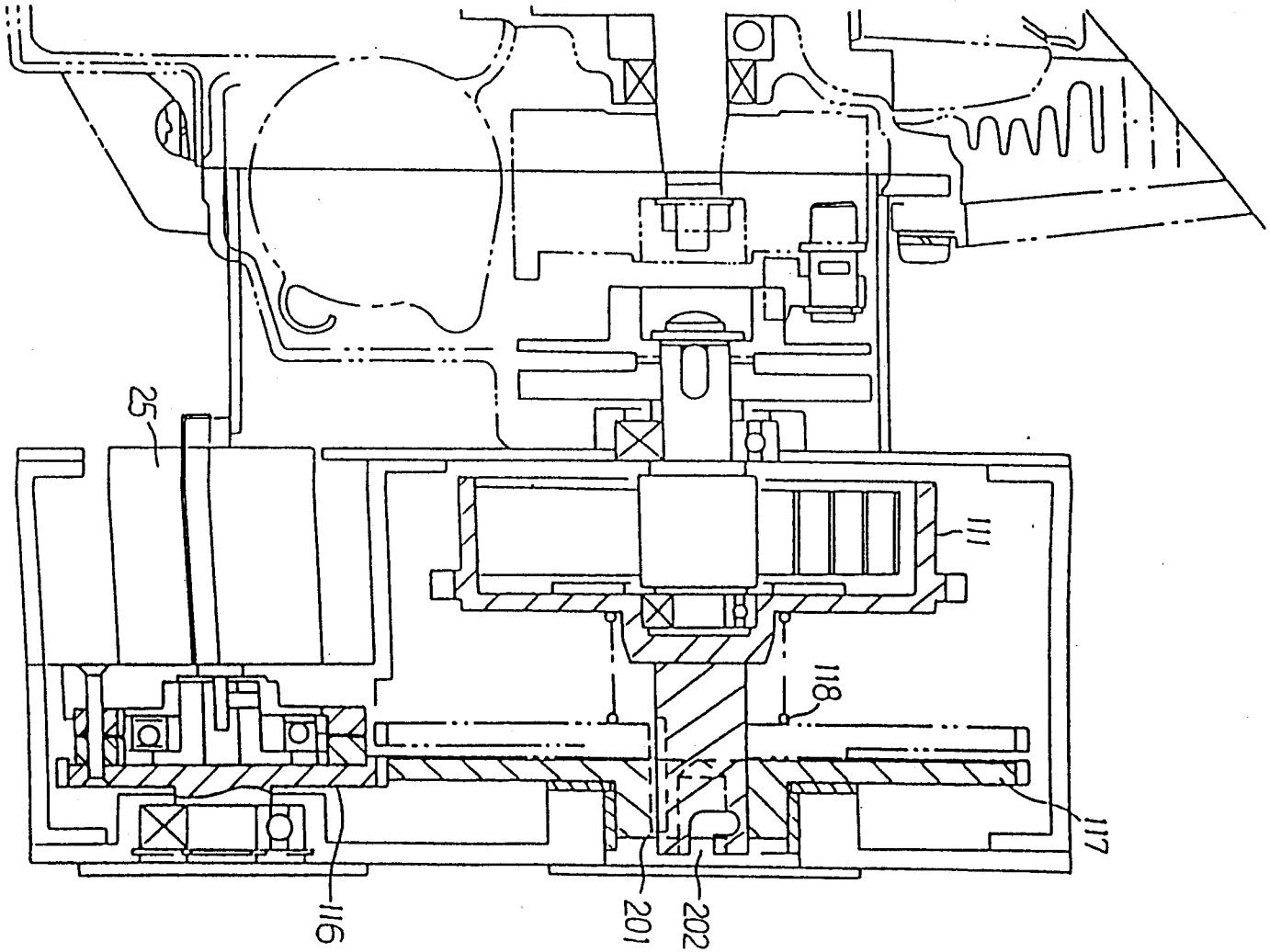
FIG. 11 is a partial longitudinal cross-section view showing another modified embodiment of the present invention provided with a hand operating cranks.
Figure 12:
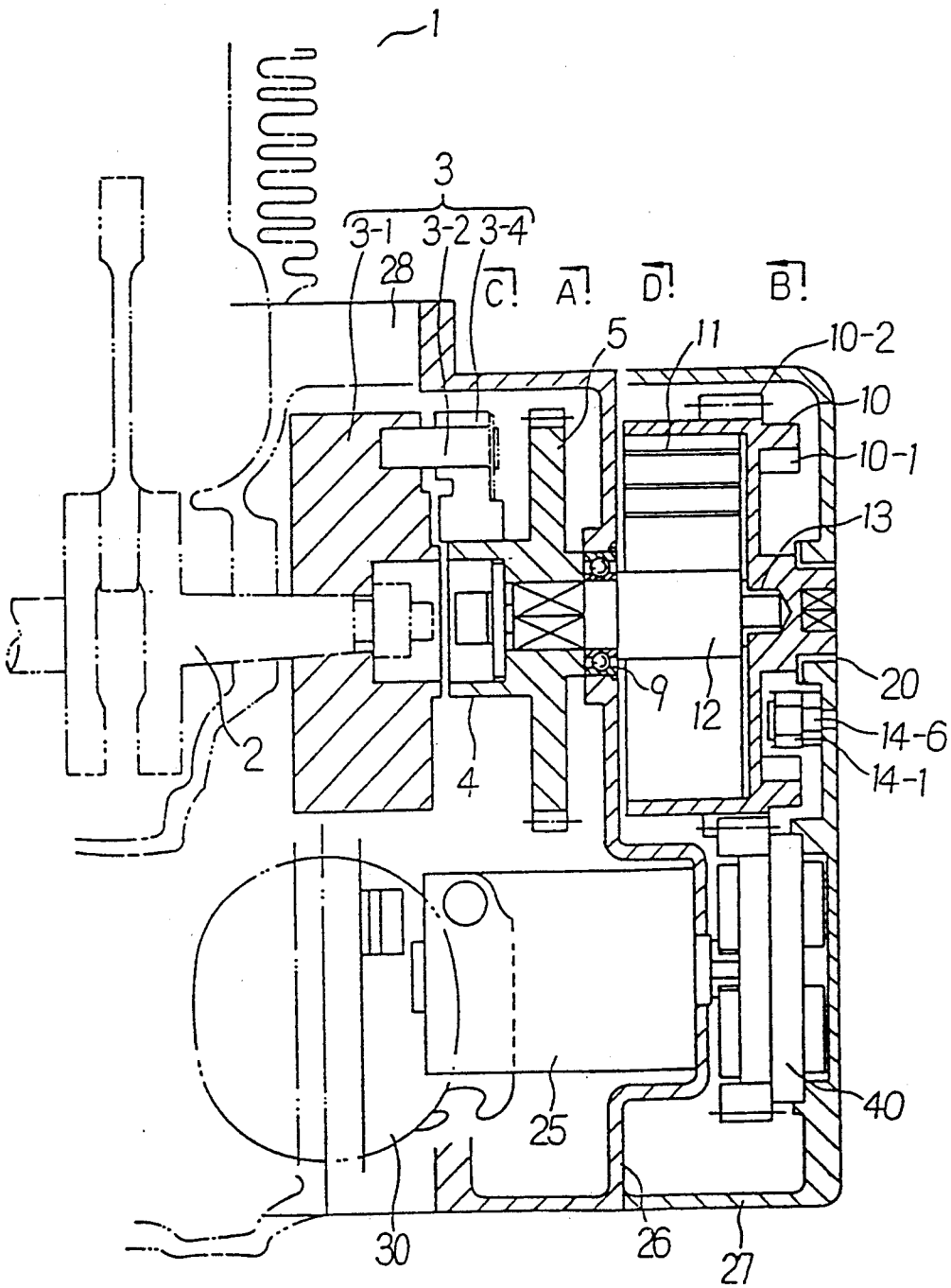
FIG. 12 is a partial longitudinal cross-section view showing an essential part of another preferred embodiment of the present invention.

It is to be noted that in the above-described preferred embodiment, it is possible to assemble a device for winding up a spiral spring by human power. FIGS. 9 to 11 show such a modified embodiment.

During normal operation of an engine, a hand operating crank 102, adapted to be inserted into the shafted gear 101. Thus, shafted gear 101 runs idle.

However, when the apparatus has failed in starting and rewinding of the spiral spring 11 is to be effected, the hand operating crank 102 is inserted into the shafted gear 101 serving as a speed reduction gear, a spring power accumulating box 10 is rotated thereby, and energy is accumulated in the spiral spring 11.

FIG. 11 shows a further modified embodiment in which a speed reduction ratio of the motor 25 to the spring power accumulating box 10 is so large that it is difficult to rotate the spring power accumulating box 10 by human power. In general, however, the structure of this embodiment is similar to that shown in FIG. 9.

Ordinarily, a gear 117 is held pushed by a spring 118 and is meshed with planetary speed reduction gears 116. Also the gear 117 is directly coupled to the spring power accumulating box 111.

However, when the spring power accumulating box 111 is to be rotated by human power, a hand operating crank 102 is inserted into a groove 202.

At this time, by inserting the hand operating crank 102 into the groove 202, the spring 118 is compressed, and the gear 117 moves, resulting in disengagement from the planetary speed reduction gears 116. It is to be noted that as the gear 117 slides along the slide key 201, deviation of a phase will not occur.

Owing to the above-described construction, if a motor driving circuit becomes faulty or an external electric power supply is not present, or in the case where the engine has failed in starting by making use of the elastic force of the spring within the spring power accumulating box, it becomes possible to rewind the spiral spring by means of a hand operating crank and to thereby start the engine. The hand operating crank is inserted only when the spiral spring is wound up by human power.

Now description will be made on another preferred embodiment of the present invention illustrated in FIGS. 12 through 25.

In FIGS. 12 to 21, reference numeral 1 designates an engine main body, numeral 2 designates a crank shaft, numeral 3 designates a magnet wheel (or rotary magnet pole) assembly, numeral 4 designates a starter ratchet wheel, numeral 5 designates a starting ratchet wheel, numeral 6 designates a starting ratchet, numeral 7 designates a shaft, numeral 9 designates a ball bearing, numeral 10 designates a spring power accumulating chamber, numeral 10-1 designates a ratchet tooth in the spring power accumulating chamber 10, numeral 10-2 designates an outer gear of spring power accumulating chamber 10, numeral 11 designates a power accumulating spring, numeral 12 designates a starter shaft, numeral 13 designates a bearing (slide or ball), numeral 20 designates a bearing (slide or ball), numeral 14-1 designates a ratchet claw, numeral 14-3 designates a shaft, numeral 14-4 designates a spring, numeral 14-5 designates a shaft, numeral 14-6 designates another shaft, numeral 25 designates a motor, numeral 26 designates a frame-A, numeral 27 designates a frame-B, numeral 28 designates a spacer, numeral 29 (FIG. 19) designates a generator coil, numeral 30 designates a generator, numeral 40 designates a high reduction ratio speed reduction mechanism, numeral 40-1 designates a sun gear, numeral 40-2 designates planet gears, numeral 40-3 designates a movable inner gear, numeral 40-4 designates a fixed inner gear, numeral 40-5 designates a planet gear fixing frame-A, numeral 40-6 designates a planet gear fixing frame-B, numeral 40-7 designates planet gear shafts, numeral 40-8 designates a fixed pin, numeral 40-9 designates inner teeth of the movable inner gear 40-3, numeral 40-10 designates outer teeth of the movable inner gear 40-3, numeral 40-11 designates inner teeth of the fixed inner gear 40-4, numeral 50 (FIG. 19) designates a spark plug, numeral 60 designates an ignition control device, numeral 70 designates an engine stop switch, numeral 80 designates a switch, numeral 90 designates a storage battery, numeral 100 designates a motor control device, numeral 120 designates a charging circuit, numeral 130 designates a switching circuit, numeral 140 designates a control circuit, numerals 121 and 123 designate diodes, numerals 122 and 136 designate capacitors, numerals 131, 133 and 127 designate transistors, and numerals 134, 135 and 137 designate resistors.

Figure 17:
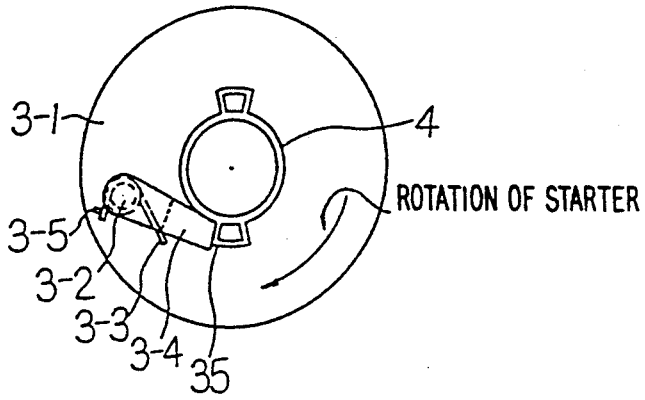
FIG. 17 is a transverse cross-section view taken along line C—C in FIG. 12.
Figure 18:
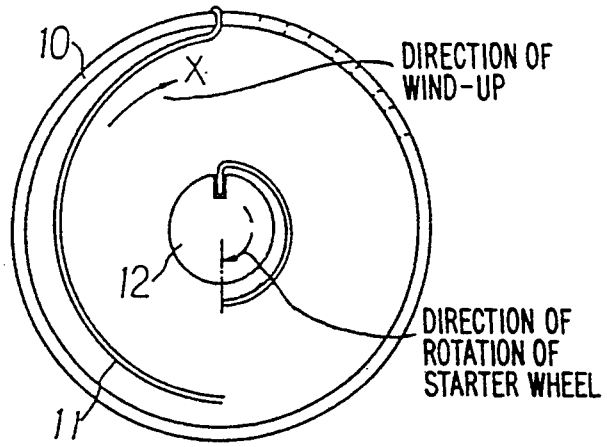
FIG. 18 is a transverse cross-section view taken along line D—D in FIG. 12.
Figure 19:
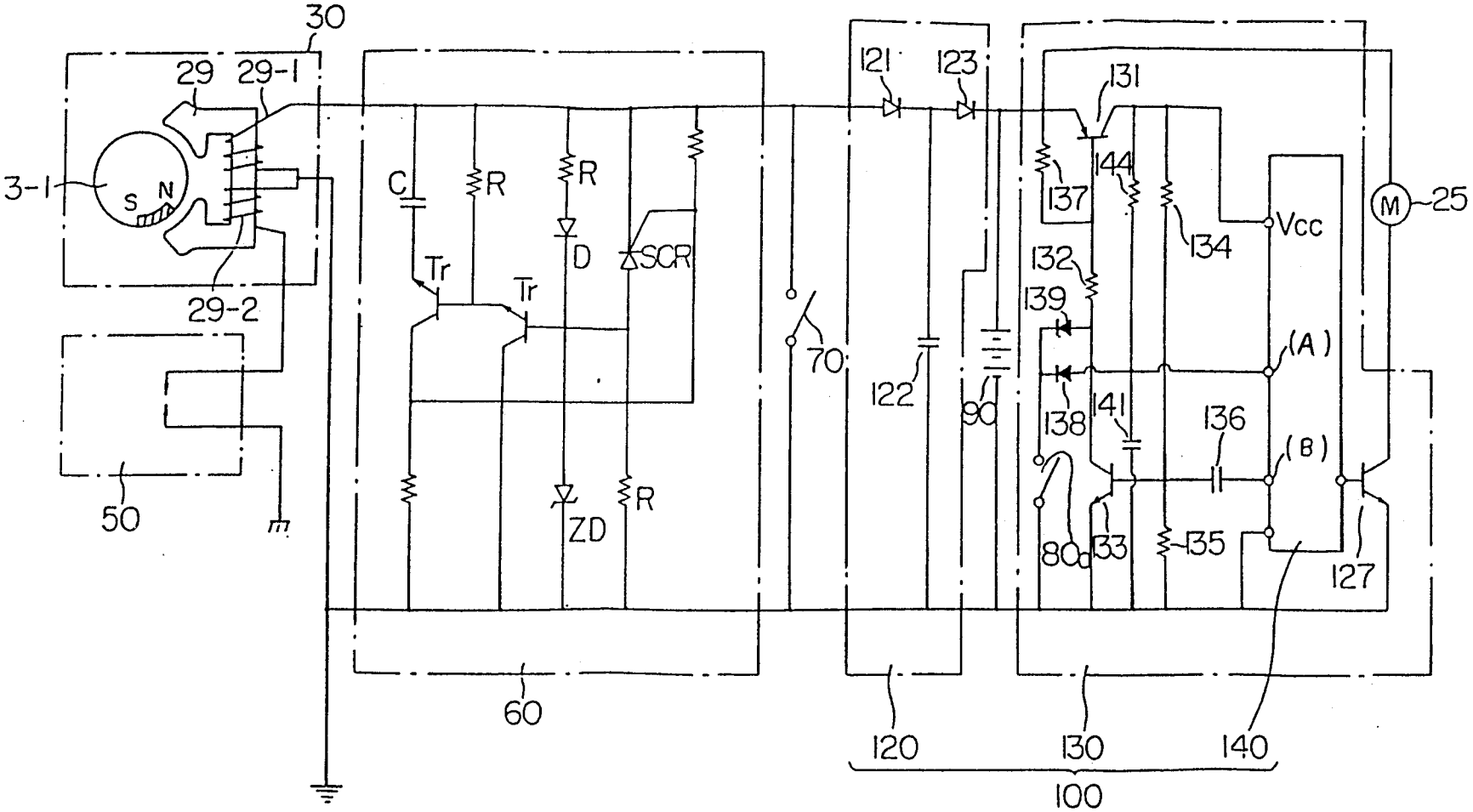
FIG. 19 is a circuit diagram of an electric power supply and a control, circuit.
Figure 20A:
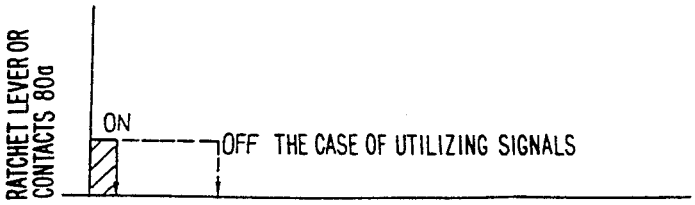
FIGS. 20(*a*)-20(*g*) are an operation timing charts.
Figure 20B:
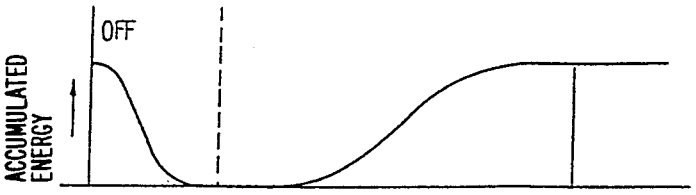
Figure 20C:
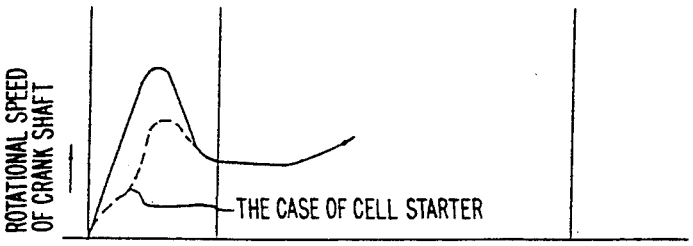
Figure 20D:
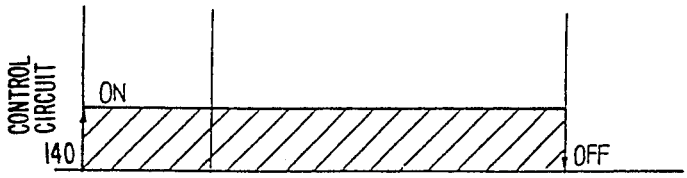
Figure 20E:
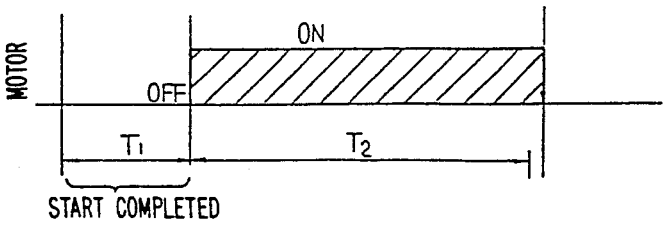
Figure 20F:
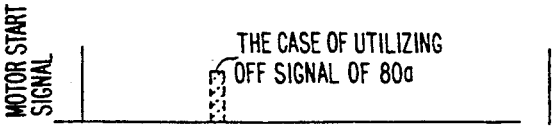
Figure 20G:
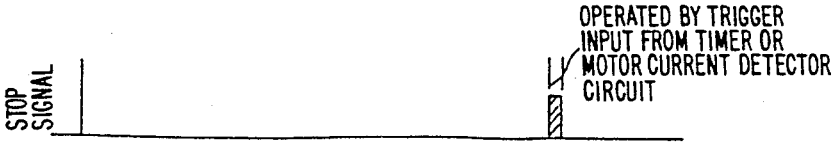
Figure 21:
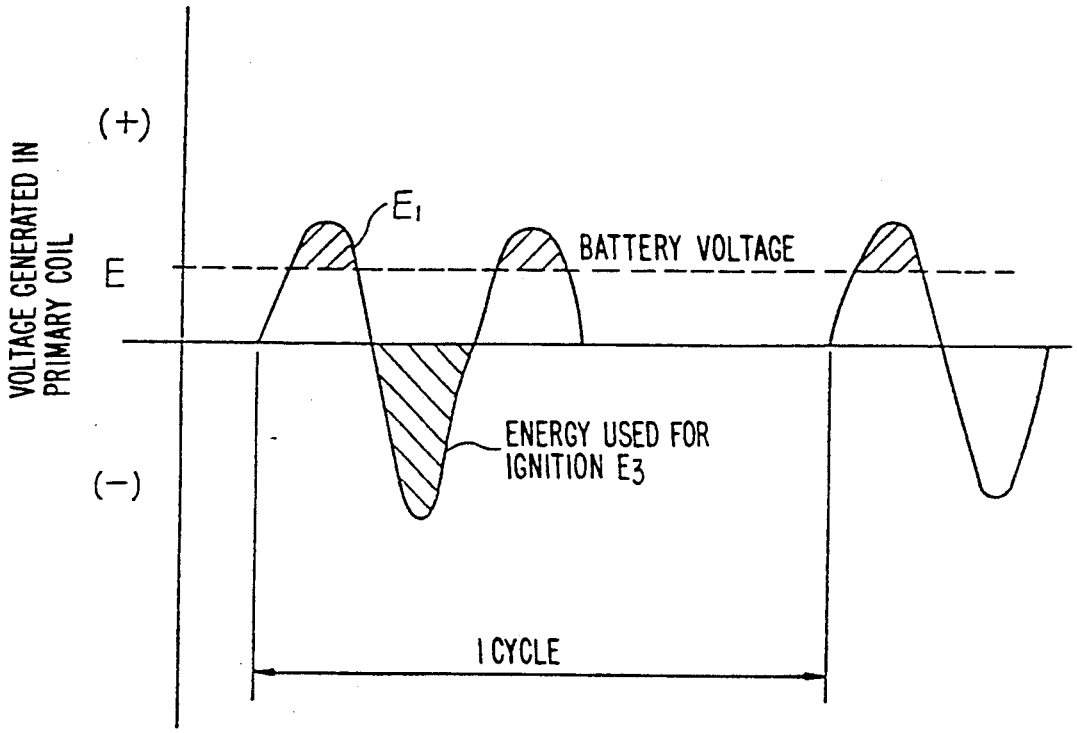
FIG. 21 is a diagram showing a waveform of a voltage generated in a primary coil of a generator.
Figure 22:
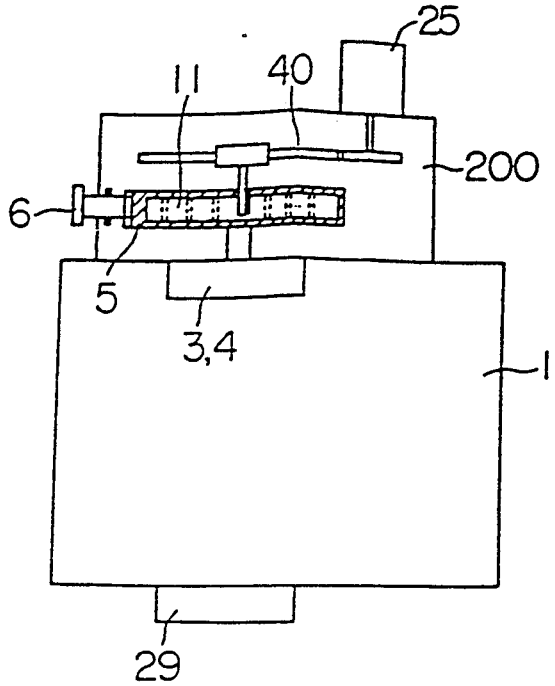
FIG. 22 is a schematic construction view of a motor type spiral spring starter.

FIGS. 12 to 18 are schematic views for explaining the structure of the principal part, FIG. 19 is a circuit diagram of a control circuit, and FIGS. 20 and 21 are diagrams for explaining the operation of the apparatus.

In the following, the details of this preferred embodiment will be explained with reference to these figures. However, component elements achieving the same functions as those in the known apparatus in the prior art are given like reference numerals, and as a rule, further explanation thereof will be omitted here.

Elementary component parts forming the apparatus are accommodated within the frame-A 26 and the frame-B 27, and they are mounted to the engine 1 via a protrusion formed integrally with the frame-A 26 or the spacer 28.

Within the frame-B 27 is disposed a principal portion for accumulating power consisting of the speed reduction mechanism 40, the spring power accumulating chamber 10, the shaft 12, the power accumulating spring 11 and the like. With this construction grease fed for lubricating purposes and the like can not be spattered externally.

Within the frame-A 26 are accommodated a principal portion for transmitting strain energy (or mechanical energy) accumulated in the power accumulating spring 11 to the crank shaft 2, the generator 30 serving as an ignition power supply for the engine 1, the ignition control device 60, the motor 25 for driving the power accumulating chamber 10, the control device 100 for the motor 25 and the storage battery 90 (FIG. 19).

Figure 15A:
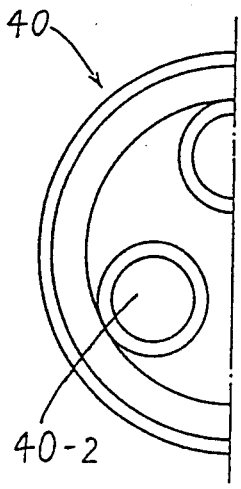
FIGS. 15(*a*) and 15(*b*) are partial cross-section views showing an essential part of a high reduction ratio speed reduction mechanism, FIG. 15(*a*) showing a transverse cross-section, and FIG. 15(*b*) showing a longitudinal cross-section.
Figure 15B:
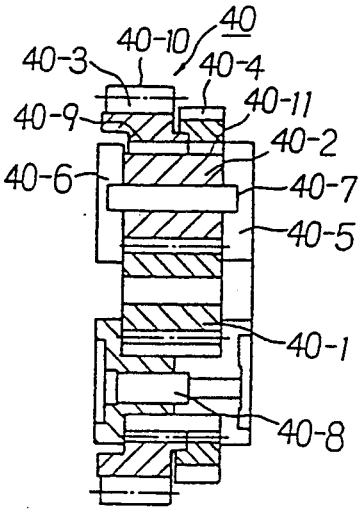

The speed reduction mechanism 40 consists of the sun gear 40-1 fixedly secured to the output shaft of the motor 25, the three planet gears 40-2 disposed along a circumference at three equal angular intervals, the movable inner gear 40-3 (number of teeth $Z_3$) internally meshed with the planet gears 40-2 with a tooth number difference of 3, the fixed inner gear 40-4 (number of teeth $Z_4$), the planet gear fixing frame-A 40-5 for fixing the relative positioning of the three planet gears, the planet gear fixing frame-B 40-6, the planet gear shafts 40-7 and the fixed pin 40-8 as shown in cross-section of an essential part in FIG. 15(*b*), the respective planet gears 40-2 are rotatable about the corresponding planet gear shafts 40-7, and the fixed inner gear 40-4 is fixedly secured to a support frame such as the frame-B 27 and is not rotatable.

Now representing the number of teeth of the sun gear 40-1 by $Z_1$, the number of teeth of the planet gear 40-2 by $Z_2$, the rotational speed of the sun gear 40-1 by $\omega$, the rotational speed of the movable inner gear 40-2 by $\Omega$, and the speed reduction ratio by m, the following relations are derived:

$$m = \frac{\omega}{\Omega} \quad (1)'$$

$$Z_4 = Z_3 + 3 \quad (2)'$$

$$m = \frac{1 + Z_4/Z_1}{1 - Z_4/Z_1} \quad (3)'$$

Assuming $m \approx 200$, if the gears having numbers of teeth $Z_2$, $Z_3$ and $Z_4$ are designed as shifted gears, the gear having the number of teeth $Z_2$ can be meshed with the gears having different numbers of teeth $Z_3$ and $Z_4$, respectively. These gears form a high reduction ratio speed reduction mechanism called "marvelous gears".

Next, the high reduction ratio speed reduction mechanism will be explained in connection with the diagrammatic models shown in FIGS. 16(*a*) and 16(*b*).

Figure 16B:
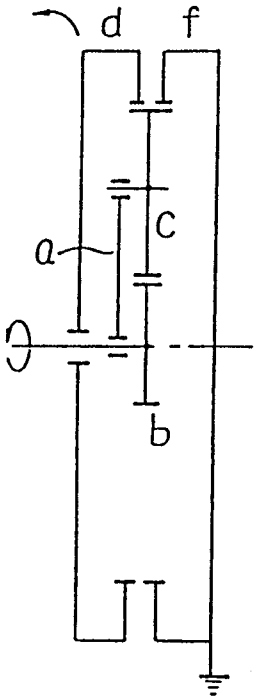
FIGS. 16(*a*) and 16(*b*) are diagrammatic views of a high reduction ratio speed reduction mechanism.
Figure 16A:
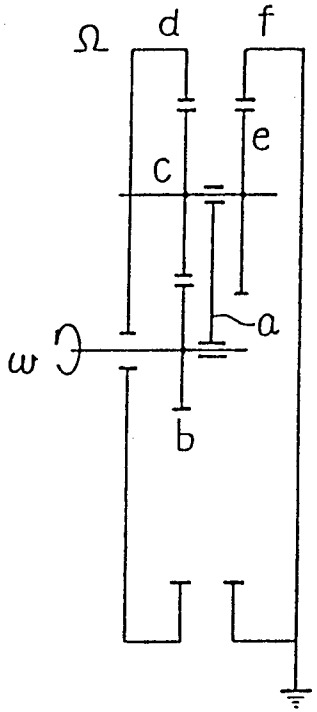

FIG. 16(*b*) shows a model for the structure shown in FIG. 15, and FIG. 16(*a*) shows a generalized case for the model shown in FIG. 16(*b*). A special case, where gears c and e have the same number of teeth and the gear v is meshed with gears d and f which respectively have different numbers of teeth, is shown in FIG. 16(*b*).

At first, with respect to the generalized case shown in FIG. 16(*a*), the rotational angle of the gear d when the gear b has been rotated, will be calculated.

Initially let us consider the case where the gear f can rotate freely.

TABLE 1

| Step | Carrier a | Gear b | Gears c, e | Gear d | Gear f |
|---|---|---|---|---|---|
| | Element | | | | |
| 1 | o (fixed) | x | $-\frac{r_b}{r_c}\cdot x$ | $-\left(\frac{r_b}{r_c}\right)x\cdot\frac{r_c}{r_d}$ | $-\left(\frac{r_b}{r_c}x\right)\cdot\frac{r_e}{r_f}$ |
| 2 | d | d | d | d | d |
| Sum | d | d + x | $d-\frac{r_b}{r_c}\cdot x$ | $d-\left(\frac{r_b}{r_c}\right)\left(\frac{r_c}{r_d}\right)\cdot x$ | $d-\left(\frac{r_b}{r_c}\right)\cdot\left(\frac{r_e}{r_f}\right)\cdot x$ |

The calculation when the carrier a was fixed and only the gear b was rotated by x is represented as step 1; the calculation when the carrier a was rotated by d is represented as step 2; and the result of the calculation in the case where the carrier a can rotate, is derived as a sum of the step 1 and the step 2.

r: a radius of a pitch circle of a gear, and the respective radii of the different gears a, b, . . . are represented by adding suffixes indicating the corresponding gears.

The algebraic sign minus (−) means reverse rotation.

In order to simplify formulae in Table-1 above, definitions for parameters $\phi^1$ and $\beta^1$ are given as follows:

$$\frac{1}{\phi} = \frac{r_b}{r_d} \quad (1)$$

$$\frac{1}{\beta} = \frac{r_b}{r_c}\cdot\frac{r_e}{r_f} \quad (2)$$

Consequently, if the rotational angles of the respective gears are represented by $\theta$ associated with suffixes indicating the individual gears, then from Table-1 above they are represented by the following formulae:

$$\theta_b = x + d \quad (3)$$

$$\theta_c = \theta_e = d - \left(\frac{r_b}{r_c}\right)\cdot x \quad (4)$$

$$\theta_d = d - \frac{1}{\phi}\cdot x \quad (5)$$

$$\theta_f = d - \frac{1}{\beta}\cdot x \quad (6)$$

Here, if the gear f is fixed, from $\theta_f = o$ the following formula is derived:

$$d - \frac{1}{\beta}\cdot x = o \quad (7)$$

Substituting Formulae (1), (2) and (7) into Formulae (3) and (5), the following formula is derived:

$$\frac{\theta_b}{\theta_d} = \frac{\omega}{\Omega} = \frac{\left(1+\frac{1}{\beta}\right)\cdot x}{\left(\frac{1}{\beta}-\frac{1}{\phi}\right)\cdot x} = \frac{1+\left(\frac{r_c}{r_b}\right)\left(\frac{r_f}{r_e}\right)}{1-\left(\frac{r_c}{r_d}\right)\left(\frac{r_f}{r_e}\right)} \quad (8)$$

Here, the modules of all the gears are made equal to M, a number of teeth of a gear is represented by Z and the numbers of teeth for the respective gears are indicated as follows:

gear b . . . $Z_1$
gear c . . . $Z_2$
gear d . . . $Z_3$
gear e . . . $Z_2'$ gear f . . . $Z_4$ At this time, the diameters of the pitch circles of the respective gears are represented as follows:

$2r_b = MZ_1$ $2r_c = MZ_2$ $2r_d = MZ_3$ $2r_e = MZ_2'$ $2r_f = MZ_4$

Therefore, the following ratio $\omega/\Omega$ can be derived:

$$\frac{\omega}{\Omega} = \frac{1 + \left(\frac{Z_2}{Z_1}\right)\cdot\left(\frac{Z_4}{Z_2'}\right)}{1 - \left(\frac{Z_2}{Z_3}\right)\cdot\left(\frac{Z_4}{Z_2'}\right)} \quad (9)$$

And if $Z_2 = Z_2'$ is assumed as shown in FIG. 16(*b*), then the following relation is obtained:

$$\frac{\omega}{\Omega} = \frac{1 + Z_4/Z_1}{1 - Z_4/Z_3} \quad (10)$$

However, since $Z_3 \neq Z_4$ was assumed, unless the respective gears are shifted gears, generally they cannot be meshed with one another.

Furthermore, if the number of the carriers a or the number of the gears c or e is represented by N, it is necessary that the numbers of teeth $Z_1$, $Z_3$ and $Z_4$ are integer multiples of N. And since the speed reduction ratio $$m = \left|\frac{\omega}{\Omega}\right|$$

becomes large when $Z_4/Z_1$ is close to 1, if N=3 is assumed, a maximum speed reduction ratio can be obtained when the following relations are fulfilled:

$$Z_4 = Z_3 + 3 \ldots \quad (11)$$

$$Z_3 = 3\cdot K \text{ (K being a natural number)} \ldots \quad (12)$$

In other words, $Z_3$ is a multiple of 3. At this time the following relation is obtained from Formulae (10) and (11):

$$m = \left|\frac{-Z_3}{3}\left(1 + \frac{Z_3 + 3}{Z_1}\right)\right| \quad (13)$$

Therefore, if a certain value of $Z_1$ is assumed, then values of $Z_1$ and $Z_3$ which approximately fulfill Formula (13) can be obtained for a given value of m. However, $Z_1$ must satisfy the following relation:

$$Z_1 = 3\cdot L \text{ (L being a natural number)} \ldots \quad (14)$$

In other words, $Z_1$ is a multiple of 3. At this time, $Z_2$ is chosen so as to satisfy the following relation:

$$\frac{MZ_3 - MZ_1}{2} \leqq MZ_2 \leqq \frac{MZ_4 - MZ_1}{2} \quad (15)$$

$MZ_2$ is an integer.

If $Z_1$, $Z_2$, $Z_3$ and $Z_4$ are determined, the shift coefficients given to the respective gears could be selected according to the theory of shifted gears, and the size of the apparatus can be reduced by selecting the module M as small as possible while paying attention to the aspect of mechanical strength.

Through the above-described procedure, a speed reduction mechanism having a speed reduction ratio as large as $m \approx 200$ can be obtained in an extremely small size.

Comparing engine starting power required in the case of employing such high reduction ratio speed reduction mechanism with that in the case of a cell starter in the prior art, by way of example, with respect to a single cylinder engine having a displacement of 24 cc, the results of comparison are as shown in Table-2 below:

TABLE 2

| | Reduction Ratio | Motor Output Power | Storage Battery Capacity |
|---|---|---|---|
| The Present Invention | 1/300 | 5 W | 180 mAh |
| Cell Starter | 1/15 | 50 W | 1200 mAh |

That is, the entire apparatus can be extremely small and compact.

Now the construction of the entire apparatus will be explained.

To the frame-A 26 is mounted the motor 25 for driving the power accumulating spring, the output shaft of the motor 25 is fixed to the center of the sun gear 40-1 in the high reduction ratio speed reduction mechanism 40, and the fixed inner gear 40-4 in the high reduction ratio speed reduction mechanism 40 is fixed to the frame-B 27.

On the axis of the crank shaft 2 of the engine 1 is disposed the shaft 12, one end of the shaft 12 is supported by the bearing 9 provided in the side wall of the frame-A 26, and the other end of the shaft 12 supports the spring power accumulating chamber 10 via the bearing 13 provided on the side surface of the spring power accumulating chamber 10.

The claw 35 of the starter ratchet wheel 4 is engaged with the claw 3-4 provided on the end surface of the magnet wheel assembly 3 disposed at an end portion of the crank shaft 2 of the engine 7 so as to be rotatable in one direction.

Figure 13:
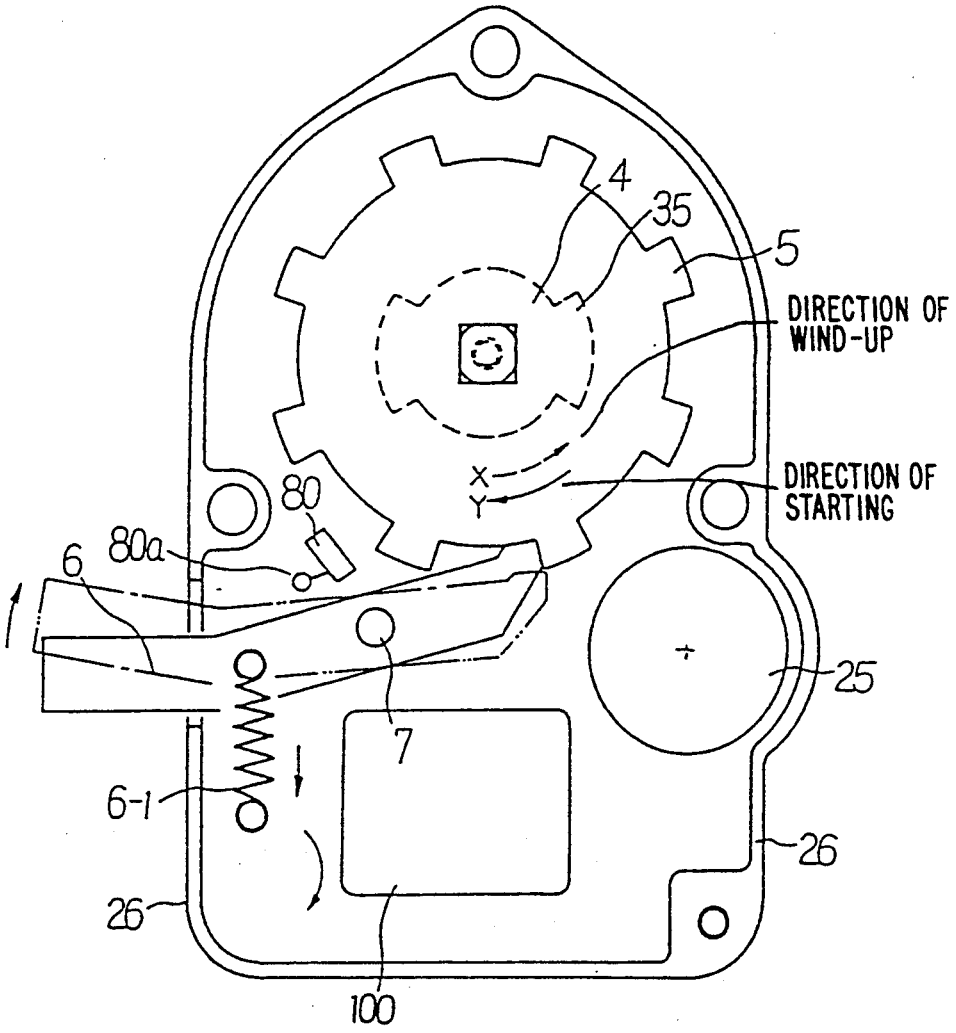
FIG. 13 is a transverse cross-section view taken along line A—A in FIG. 12.

And on the outer circumference of the starting ratchet wheel 5 are provided a large number of protrusions as shown in FIG. 13, which are engaged with the starting ratchet 6 so as to be capable of stopping rotation at any arbitrary position.

The starting ratchet 6 is rotatably supported by the shaft 7 fixedly secured to the frame-A 26, and it is always subjected to a force for butting against the outer periphery of the ratchet wheel 5 by the spring 6-1, hence except for the time when the ratchet lever 6 is forcibly operated by an external force, the ratchet lever 6 prevents the ratchet wheel 5 from rotating.

The switch 80 having contact 80*a* is provided to detect a condition in which the ratchet lever 6 has been displaced by an external force and the whirl-stop for the ratchet wheel 5 has been released.

The spring power accumulating chamber 10 is rotatable with respect to the shaft 12 owing to the bearing 13, and also it is rotatable with respect to the frame-B 27 owing to the bearing 20. On the other hand, on the outer circumference of the power accumulating chamber 10 is provided the gear 10-2, which is meshed with the outer gear 40-10 provided on the outer circumference of the movable inner gear 40-3 in the high reduction ratio speed reduction mechanism 40, and thereby a speed reduction gear system is constructed.

Within the spring power accumulating chamber 10 is provided the power accumulating spring 11 so as to surround the shaft 12, and the opposite ends of the power accumulating spring 11 are respectively fixed as shown in FIG. 18.

In addition, the power accumulating spring chamber 10 is provided with ratchet teeth 10-1 of inner tooth type or outer tooth type, which forms, jointly with the ratchet claw 14-1 provided on the frame-B 27, a whirl-stop mechanism that is rotatable in one direction.

On the frame-A 26 side of the shaft 12 is fixed the starting ratchet wheel 5, and as shown in FIG. 17, the starter ratchet wheel 4 having the claw 35 is provided integrally with the starting ratchet wheel 5.

A torque generated by the motor 25 will rotate the spring power accumulating chamber 10 via the high reduction ratio speed reduction mechanism 40.

On the other hand, since the shaft 12 is prevented from rotating by the ratchet 6 and the ratchet wheel 5, the power accumulating spring 11 is wound up about the shaft 12. When predetermined winding has been done, rotation of the motor 25 is stopped, but maintenance of the wound-up state (the power accumulating condition) is effected by the ratchet wheel 10-1 and the ratchet claw 14-1.

Starting from this state, if the rotation of the ratchet wheel 5 is freed by applying a force to the starting ratchet 6, the energy accumulated in the spiral spring 11 momentarily causes the shaft 12 to rotate. This causes, the starter ratchet wheel 4 to rotate the crank shaft 2 via the magnet wheel 3 and thereby start the engine 1.

When the engine has been started, the claw 3-4 of the magnet wheel 3 is disengaged from the claw 35 of the starter ratchet 4, and hence the engine is disconnected from the driving system for the shaft 12.

In FIG. 19 are illustrated the power supply and the control circuit for the motor 25. Reference numeral 30 designates a rotary permanent magnet type generator consisting of the magnet wheel (or rotary magnetic pole) assembly 3 and the coil 29, numeral 60 designates an ignition control device, numeral 50 designates a spark plug, numeral 70 designates an engine stop switch, numeral 80 designates a switch for detecting operation of the starting ratchet 6, numeral **80*a* designates contacts of the same switch, and numeral 100 designates a control device for driving the motor 25. Reference numeral 29-1 designates a primary coil of a stator coil 29 in the generator 30, and numeral 29-2** designates a secondary coil of the same. These primary and secondary coils form an autotransformer, their common line being grounded at the engine main body.

The section composed of the generator 30, the ignition control device 60, the spark plug 50 and the switch 70 is known in the prior art, and so, further explanation thereof will be omitted here.

Now description will be made of the motor control device 100.

The control device 100 is constructed of a charging circuit 120, a switching circuit 130 and a control circuit 140. This control device 100 drives the motor 25 by making use of the contacts **80*a* of the switch 80** to provide an input signal.

The charging circuit 120 achieves a charging function by means of the electric power generated by the generator 30 which is directly coupled to the engine 1 to be operated. This circuit is composed of a rectifier diode 121, a smoothening capacitor 122, a reverse current preventing diode 123 and storage battery 90.

In the switching circuit 130, in the initial state since the transistor 131 is held OFF, electric power is not fed to the control circuit 140, and the motor 25 is maintained in a deactivated condition.

Next, when the ratchet lever 6 is pressed, the spiral spring 11 releases energy and starts the engine 1, and at the same time the ratchet lever 6 presses the switch 80, so that its contact **80*a* is grounded. Since the contact 80*a* is connected to a base of a PNP transistor 131 via a reverse current preventing diode 139, the base voltage of the transistor 131 is lowered, the transistor 131 is turned ON, and electric power is fed to the control circuit 140. Thereby a base of an NPN transistor 133 is fed a voltage higher than an ON voltage that is produced as a result of voltage division by resistors 134 and 135. Hence, the transistor 133 is turned ON and, at the same time the base voltage of the transistor 131 is lowered via a resistor 132 and the ON state of the transistor 131 is maintained, so that even if the ratchet lever 6 is restored to the original position and the contact 80*a* is opened, the control circuit 140** is supplied with electric power.

The control circuit 140 is a circuit for controlling the current feed timing for the motor 25 for winding up the power accumulating spring 11, and while there are two types of circuits including a timer type and a motor current detection type, either type is acceptable.

In order to start current feed to the motor 25, a predetermined period after the commencement of current feed to the control circuit 140, that is, after time $T_1$ required for starting the engine has elapsed, a timer $T_2$ is turned ON, or the restoration signal of the contact of the ratchet lever 6, that is, the rising signal generated as a result of the fact that a signal (A) held at L-level via a diode 138 is raised to H-level via a pull-up resistor 144 when the contact **80*a* of the switch 80 is opened, is utilized. In other words, after time $T_1$ has elapsed, by means of a timer $T_1$ which operates simultaneously with switching ON of the control circuit 140, or in response to the opening signal of the contact 80*a*, that is, in response to the level change L→H of the signal (A), a timer $T_2$ is operated, and after time $T_2$ has elapsed, a transistor 127 is turned ON, and electric power is fed to the motor 25. The wind-up time $T_2$ of the power accumulating spring 11 is preset by a timer circuit within the control circuit 140, and when it has become the wind-up time, the transistor 127 is switched OFF and at the same time the stop signal (B) is changed from H to L. The stop signal (B) is transmitted to the base of the transistor 133 via a coupling capacitor 136, resulting in lowering of the base potential of the transistor 133, and the transistor 133 is turned OFF. When the transistor 133 has been turned OFF, the base potential of the transistor 131 rises, hence the transistor 131 is turned OFF, and the control circuit 140 attains a power-interrupted condition. Accordingly, the transistor 127 is also turned OFF, and power supply to the motor 25 is interrupted. A capacitor 141 shown in FIG. 19** is provided to prevent noise, but can be omitted.

In the case of the wind-up detection type circuit, upon starting the motor, the transistor 127 is turned ON in a similar manner to the above-described timer type circuit, and thereby electric power is fed to the motor 25 to wind up the spiral spring 11. At the time when the spiral spring 11 has been fully wound up, by making use of the fact that a motor current increases, the stop signal (B) is generated by motor current detector means, and thereafter the motor 25 is stopped in a similar manner to the above-described timer type circuit.

The fact that the motor 25 is in operation, can be appropriately communicated to an operator by connecting an indicator lamp or a buzzer in parallel to the motor 25.

Operation timing of the principal part of the above-described control operation is shown in FIG. 20.

In this figure, with regard to the rising characteristic of the rotational speed of the crank shaft upon starting of the engine, comparing the characteristic of the apparatus according to the present invention indicated by a solid line and that of the apparatus of cell starter type indicated by a dotted line, it can be seen that in the case of the cell starter type, a surplus, with respect to the lowest rotational speed that is necessary for cranking in order to reduce a motor capacity, is small as compared to the case of the present invention. According to the present invention, due to the bursting effect of the spring type starter, the device can be made small and compact.

The voltage generated in the primary coil during operation of an engine is as shown in FIG. 21, and it has a distorted waveform as illustrated in the figure. At this time, if the battery voltage E is preset somewhat lower than the potential on the (+) side of the generated voltage, then the energy $E_1$ of the hatched portion not used for ignition can be utilized for charging of the battery 90.

It is to be noted that if a square hole leading to the outside is formed in the boss portion of the spring power accumulating chamber 10, then power accumulation by human power is possible in case of an emergency.

Next, an automatic wind-up control device will be explained with reference to FIGS. 22 to 25.

Figure 23:
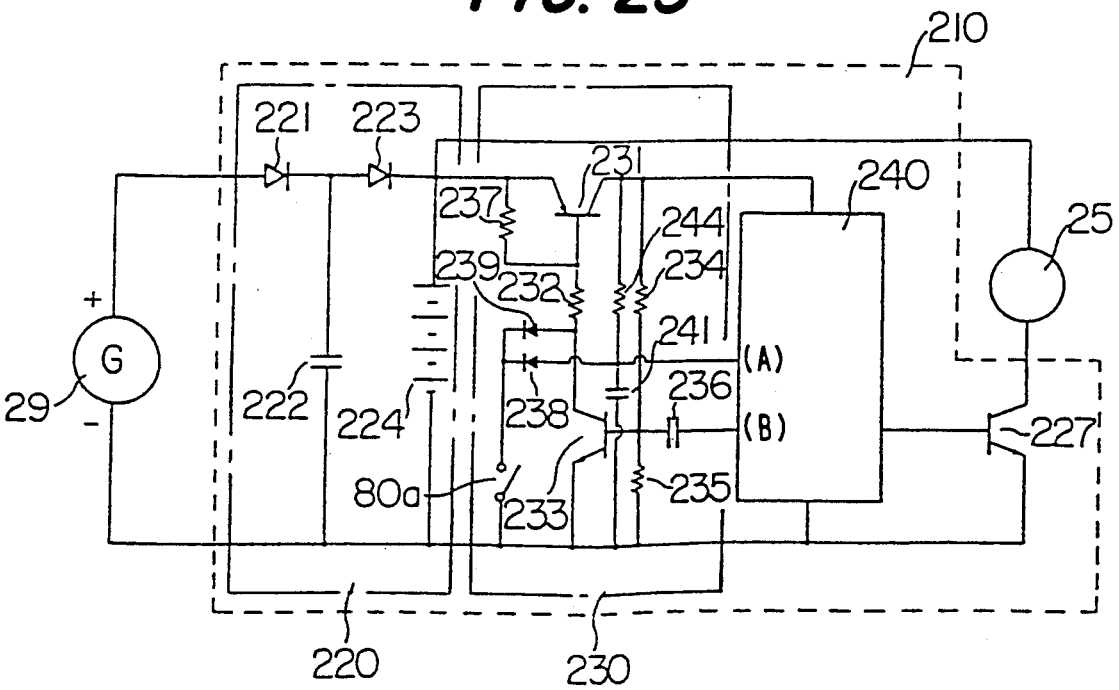
FIG. 23 is a circuit diagram of a control device according to this preferred embodiment of the present invention.
Figure 24:
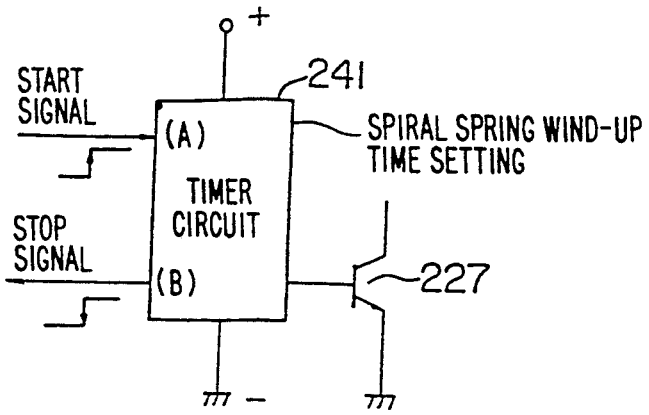
FIG. 24 is a schematic construction view of a motor control section of a timer type control device.
Figure 25:
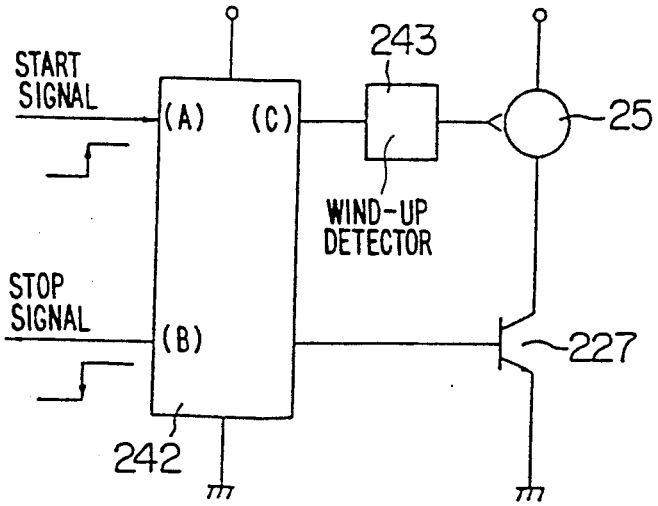
FIG. 25 is a schematic construction view of a motor control section associated with a wind-up detector.
Figure 26:
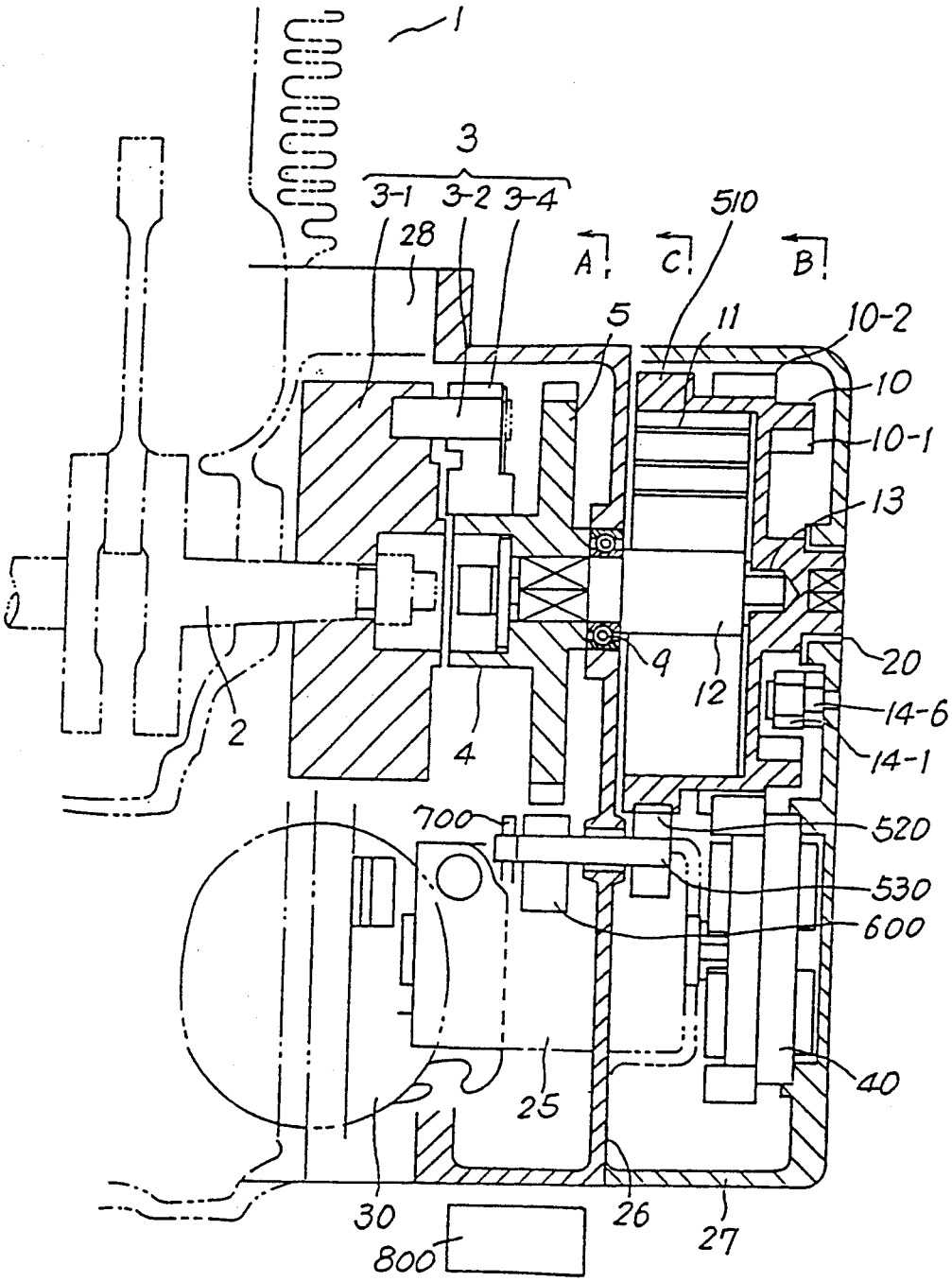
FIG. 26 is a partial longitudinal cross-section view showing an essential part of a still another preferred embodiment of the present invention.

An automatic wind-up control device 210 is constructed of a charging circuit 220, a switching circuit 230 and a control circuit 240 as shown in FIG. 23, and it drives the motor 25 in response to an input signal generated at the switch contact 80*a* of the starting ratchet 6.

The charging circuit 220 serves to charge a storage battery 224 with electric power generated by the generator 29 as if it was directly coupled to the engine 1. This circuit 220 is composed of a rectifier diode 221, a smoothing capacitor 222, a reverse current preventing diode 223 and the battery 224. This charging circuit 220 can be replaced by a dry cell or an external power supply such as, for instance, a storage battery of a motor car.

In the switching circuit 230, in the initial state, as a transistor 231 is held OFF, electric power is not fed to the control circuit 240, and the motor 25 is maintained in a stopped condition.

Next, when the starting ratchet 6 is pressed, the spiral spring 11 releases energy and starts the engine 1, and at the same time the contact 80*a* of the starting ratchet 6 is grounded. Since the contact 80*a* is connected to the base of the transistor 231 via a reverse current preventing diode 239 and a resistor 232, the transistor 231 is turned ON, and electric power is fed to the control circuit 240. Thereby, a base of an NPN transistor 233 is fed with a voltage higher than an ON voltage that is produced as a result of voltage division by resistors 234 and 235. Hence, the transistor 233 is turned ON, and the base voltage of the transistor 231 is lowered via the resistor 232 and the ON state of the transistor 231 is maintained, so that even if the contact 80*a* is opened by restoring the starting ratchet 6 to the original condition, the control circuit 240 is maintained in a current feeding state.

Figure 14:
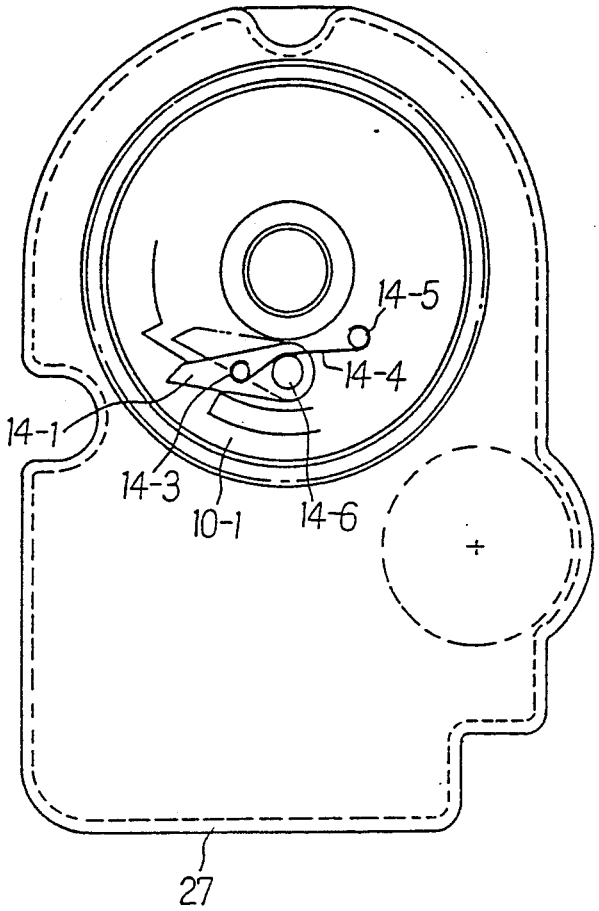
FIG. 14 is a transverse cross-section view taken along line B—B in FIG. 12.

The control circuit 240 is a circuit for controlling current feed to the motor 25 for winding up a spiral spring, and there are two type of circuits including a timer type shown in FIG. 13 and a spiral spring wind-up detection type shown in FIG. 14. While current can be simultaneously fed to the motor 25 and the control circuit 240, in this preferred embodiment the most efficient return signal of the contact of the starting ratchet 6, that is, the rising signal of the signal (A) generated by closing/opening of the contact 80*a* is utilized.

In the case of the timer type circuit, a transistor 227 is turned ON by the above-mentioned signal, and a current is fed to the motor 25. A wind-up time of the spiral spring 11 is preset by a timer 241, and after the wind-up time has elapsed the transistor 227 is turned OFF, and at the same time the stop signal (B) changes from H-level to L-level. The stop signal (B) is transmitted via a coupling capacitor 236 to the base of the transistor 233, such that the base potential of the transistor 233 is lowered and the transistor 233 is turned OFF. When the transistor 233 has been turned OFF, the base potential of the transistor 231 rises and the transistor 231 is turned OFF, so that the control circuit 240 attains a current feed interruption state. Accordingly, the transistor 227 is turned OFF and current feed to the motor 25 is interrupted.

In the case of the wind-up detection type circuit, the transistor 227 is turned ON by the signal generated by closing/opening of the contact 80*a*, such that a current is fed to a control circuit 242 and the motor 25 to wind up the spiral spring 11. When the spiral spring 11 has been wound up, on the basis of a current input (C) from a wind-up detector device 243, the stop signal (B) is changed from H-level to L-level, and thereafter the motor 25 is stopped in a similar manner to the timer type circuit.

In this way, the spiral spring 11 can be wound up automatically, so that the starter apparatus is always maintained in a state ready to start the engine, and the labor of winding up the spiral spring becomes unnecessary.

In the last-mentioned preferred embodiment, owing to the fact that in a general purpose gasoline engine including a rotary magnet type generator and an ignition timing control circuit, there are provided a charging circuit disposed in parallel to the ignition timing control circuit, a storage battery for accumulating electric power fed from the charging circuit, a D.C. motor driven by electric power accumulated in the storage battery, a control unit for controlling operation and stoppage of the D.C. motor, a high reduction ratio speed reduction mechanism for transmitting mechanical power of the D.C. motor, a spiral spring type power accumulator device for accumulating mechanical energy in response to a torque exerted by the aforementioned speed reduction mechanism, and a one-way type power transmission element for transmitting energy accumulated in the above-mentioned spiral spring to a crank shaft, the following advantage can be attained.

That is, since the apparatus comprises a storage battery for making use of the (+) side electric power of a generator for ignition power supply (which was not used in the prior art) as charging energy during operation of an engine, it becomes possible to accumulate power in the spiral spring a plurality of times.

Accordingly, even during times when starting characteristics are degraded, such as the winter season, it becomes possible to carry out cranking of an engine without employing human power by making use of a restoring force of a spiral spring a plurality of times. Hence, the anxiety of being unable to start the engine is eliminated. Also, by utilizing "marvelous gears" as a speed reduction mechanism it is easy to select a high speed reduction ratio of about $$\frac{1}{250} - \frac{1}{300}$$

for the total speed reduction ratio. Therefore, as compared to the cell starter system, it is possible to reduce the capacity of the motor for use in the power accumulation by a factor of about $_{10}{}^{1}$ (50 W→5 W) and the capacity of the battery by a factor of $_{6}{}^{1}$ or less (1200 mAH→180 mAH), such that an extremely light weight apparatus can be provided.

Furthermore, since motor control is effected so that automatic winding up of the power accumulating spring may be carried out immediately after the starting operation of the engine, even in the event that the apparatus fails to start the engine, only a small amount of waiting time is necessary before attempting to start it again. For the next starting attempt, it is only necessary to pull the ratchet lever.

FIGS. 26 to 30 show still another preferred embodiment of the present invention, and in these figures, component parts having similar functions to those appearing in the previously described embodiments are given like reference numerals, and further explanation thereof will be omitted.

In FIGS. 26 to 30, reference numeral 500 designates a one-revolution converter mechanism, numeral 510 designates a drive gear, numeral 520 designates a memory gear, numeral 521 designates teeth of the memory gear 520, numeral 522 designates a circular arc portion of the same, reference character A designates the opposite ends of the circular arc portion 522, reference numeral 600 designates a cam, numeral 700 designates ON-OFF contacts, numeral 710 designates an annular conductor having a slit-shaped insulator on its outer circumference, numeral 711 designates the slit-shaped insulator, numeral 720 designates a sheet conductor, numeral 750 designates an ON-OFF switch, and numeral 800 designates a D.C. power supply.

To the spring power accumulating chamber 10 is mounted the drive gear 510 provided with two teeth 511 along an outer circumference of a disc 512, and this drive gear 510 rotates in phase with the spring power accumulating chamber 10.

Outside of the drive gear 510 is provided the memory gear 520 which is a Geneva drive gear having five teeth 521 to be meshed with the teeth 511 of the drive gear 510. When the teeth of these gears 510 and 520 are not meshed with each other, they are held in sliding contact along their contour lines, and the memory gear 520 on the driven side will not rotate.

Figure 28A:
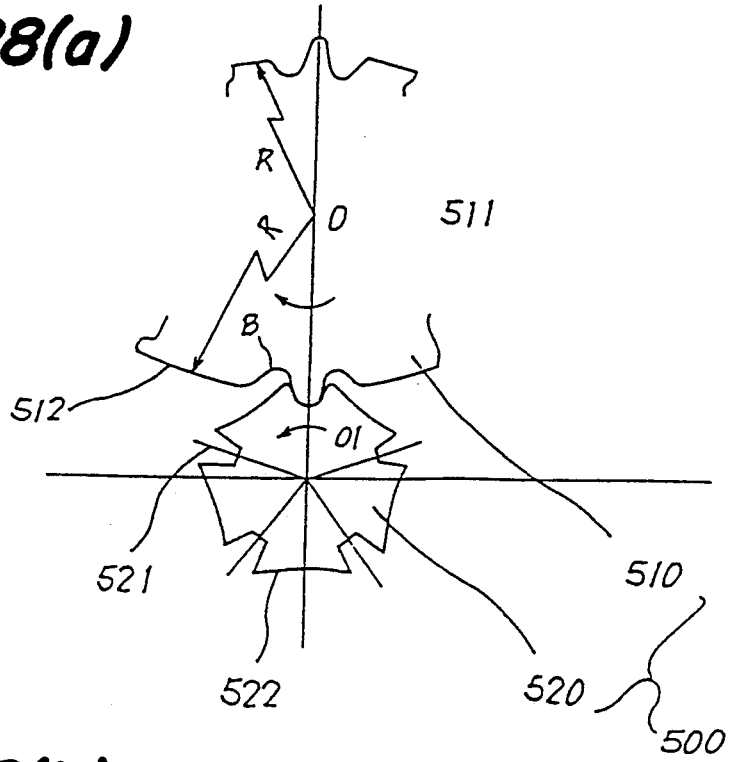
FIGS. 28(*a*) and 28(*b*) are diagrammatic views for explaining the operation of the one revolution converter mechanism in FIG. 27.
Figure 28B:
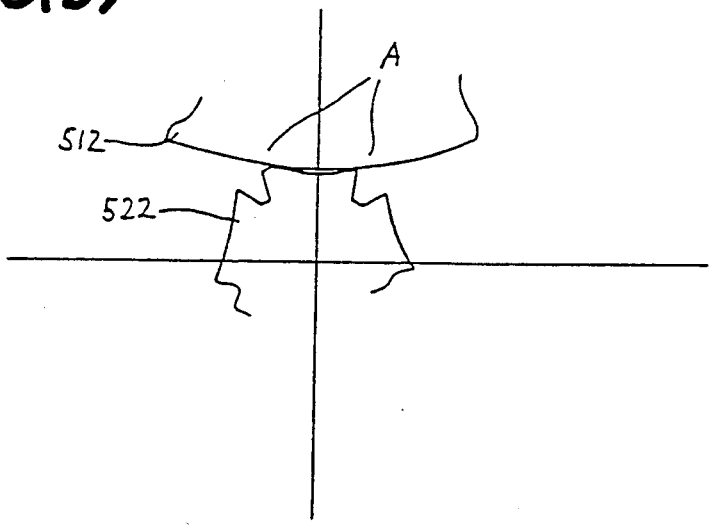

As described above, the one-revolution converter mechanism 500 consists of the drive gear 510 and the driven memory gear 520, and when the tooth 521 of the memory gear 520 and the tooth 511 of the drive gear 510 are meshed with each other as shown in FIG. 28(*a*), the memory gear 520 is rotated by the torque of the drive gear 510. If the meshed relation is released, the circular arc portion 522 of the memory gear 520 and the circumferential portion 512 of the drive gear 510 between the points A, A are held in sliding contact as shown in FIG. 28(*b*), so that rotation of the memory gear 520 is prevented.

When the drive gear 510 has rotated by 180°, the next tooth that is 180° out-of-phase with respect to the previously meshed tooth would be meshed with the next tooth of the memory gear 520.

In this way, the memory gear 520 will rotate by 72° for every 180° rotation of the drive gear 510. In other words, when the drive gear 510 rotates by 2.5 revolutions, the memory gear 520 makes one revolution.

Accordingly, if the numbers of teeth and the rotational angles of the drive gear 510 and the memory gear 520 are represented by $Z_d$, $\theta_d$, $Z_m$ and $\theta_m$, respectively, then the following relation is established:

$$\frac{\theta_m}{\theta_d} = \frac{Z_d}{Z_m}$$

Here, if $\theta_m = 360°$ (one revolution) and $\theta_d = 900°$ (2.5 revolutions), the numbers of teeth $Z_d$ and $Z_m$ fulfilling the relation of $\theta_m/\theta_d = 1/2.5$ is given by $Z_d = 2$ and $Z_m = 5$. If a motion shaft and the drive gear, and a control shaft and the memory gear, are respectively synchronized, then a particular rotational angle of the motion shaft can be output as one revolution of the control shaft.

In the case of this preferred embodiment, the motion shaft is the rotary shaft of the spring power accumulating chamber 10, that is, the shaft 12, and the control shaft is the rotary shaft of the memory gear 520. Since the spring power accumulating chamber 10 and the drive gear rotate in an in-phase relationship and the cam 600 and the ON-OFF contacts 700 rotate in an in-phase relation with respect to the memory gear, for a particular rotational angle of the spring power accumulating chamber 10, the cam 600 and the ON-OFF contacts rotate one revolution. If this angular displacement with respect to the shaft 12 of the spring power accumulating chamber 10 is made to coincide with the angular displacement of the above-mentioned particular rotational angle and it is interpreted to be the time of completion of wind-up of the spring 11, then the process of the spiral spring 11 being wound up about the shaft 12 by a predetermined angle can be preset as one revolution of the control shaft 530, that is, as one cycle.

While an example of selecting the number of times of wind-up for the spiral spring 11 as 2.5 times was disclosed in this preferred embodiment, it is obvious from the nature of the above-described one-revolution converter mechanism 500 that the invention should not be limited to this number.

As the one cycle from the beginning of winding of the spiral spring 11 in the power accumulating chamber 10 to the completion of winding can be converted into one revolution of the control shaft 530 by the above-described structure, automatic wind-up of the power accumulating spring and starting of the engine can be carried out automatically by effecting control of the engagement/disengagement timing of the starting ratchet lever 6 by means of the cam 600 and by controlling start/ stop of the motor by means of the switch 750 and the ON-OFF contacts 700 during one revolution of the control shaft.

At first, stopping operation of the motor 25 is effected in the following manner.

Figure 29A:
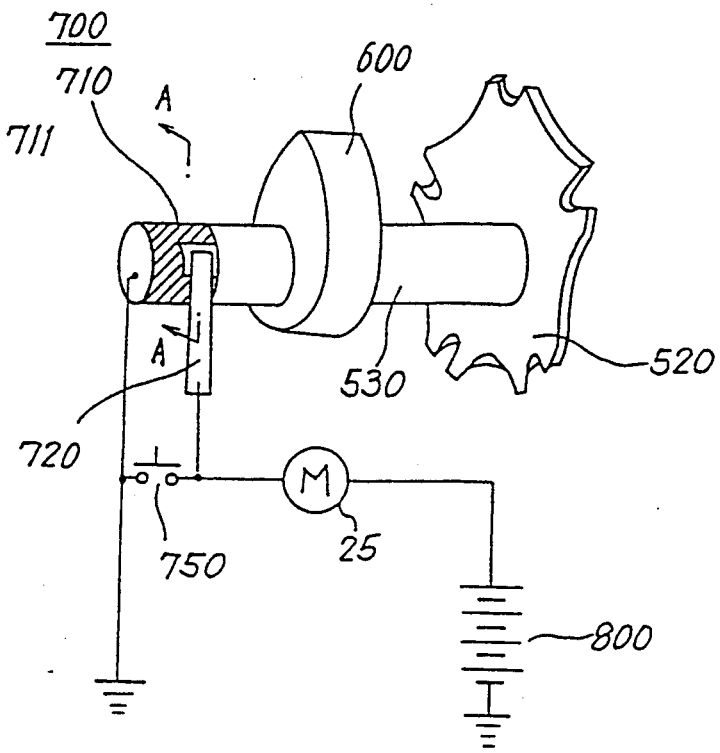
FIG. 29(*a*) is a perspective view showing a motor control circuit in the one revolution converter mechanism.
Figure 29B:
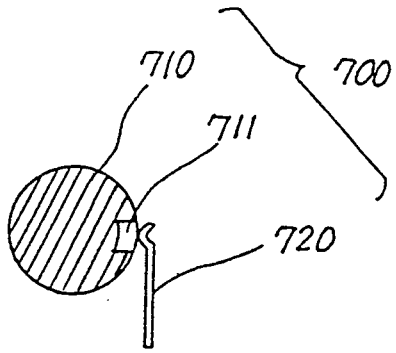
Figure 30A:
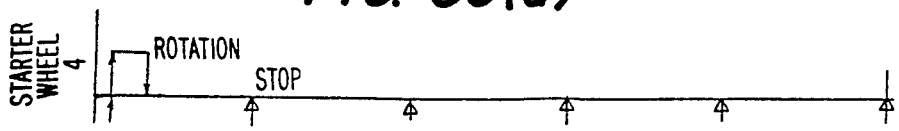
FIGS. 30(*a*)-30(*f*) are operation diagrams.
Figure 30B:
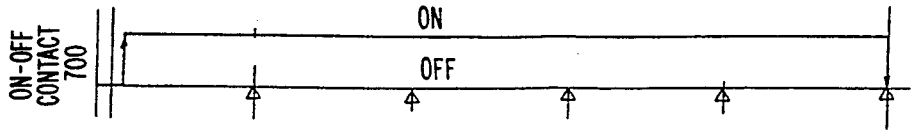
Figure 30C:
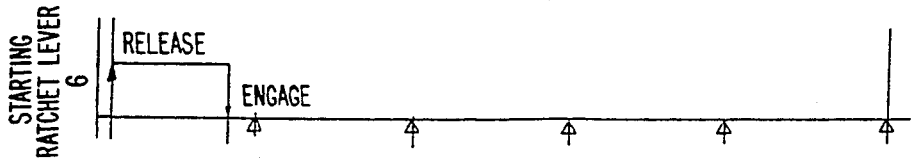
Figure 30D:
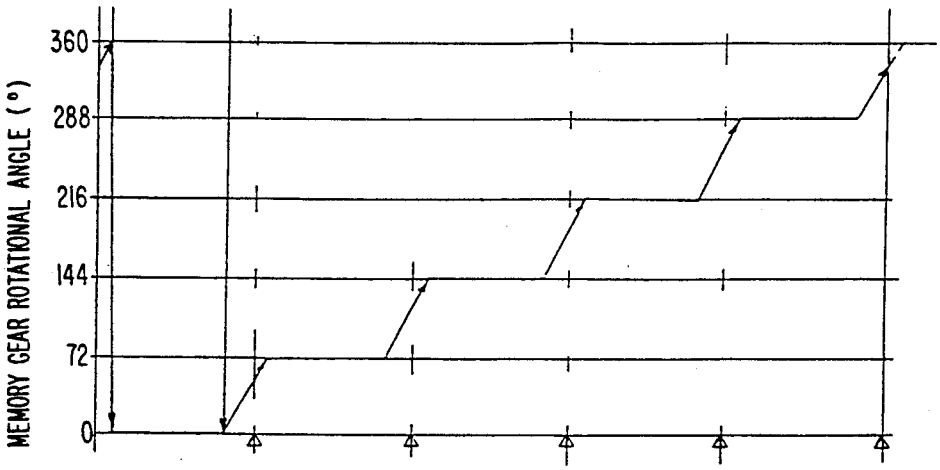
Figure 30E:
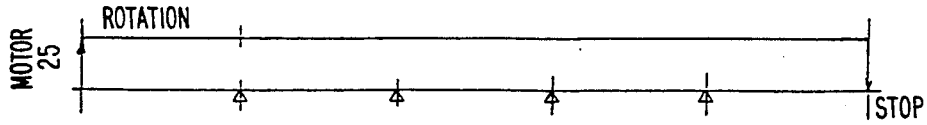
Figure 30F:
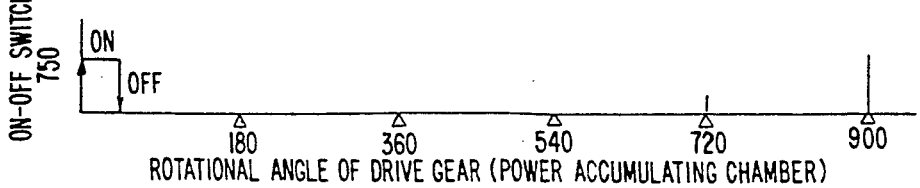

In FIG. 29, the ON-OFF contacts 700 are composed of the annular conductor 710 fixedly secured to the control shaft 530 in an in-phase relationship to the memory gear 520 and having the slit-shaped insulator 711 on its outer circumference, and a sheet conductor 720. The sheet conductor 720 is connected in series with the motor 25 and the D.C. power supply 800, while the annular conductor 710 is grounded at the engine body via the control shaft 530.

On the other hand, the ON-OFF contacts 700 are connected in parallel with the switch 750 having one end grounded, and the negative pole of the power supply 800 for the motor 25 is grounded at the engine body.

It is assumed that in the initial state, the sheet conductor 720 forming the ON-OFF contacts 700 is held in contact with the insulator 711 such that the ON-OFF contacts 700 are in an opened state (OFF state).

Under this condition, since the circuit connecting the motor 25 with the power supply 800 is open, the motor is maintained in a deactivated condition.

At this time, if the switch button 750 is depressed, the motor 25 and the power supply 800 are connected in a closed circuit, such that, the motor 25 is activated.

Figure 27:
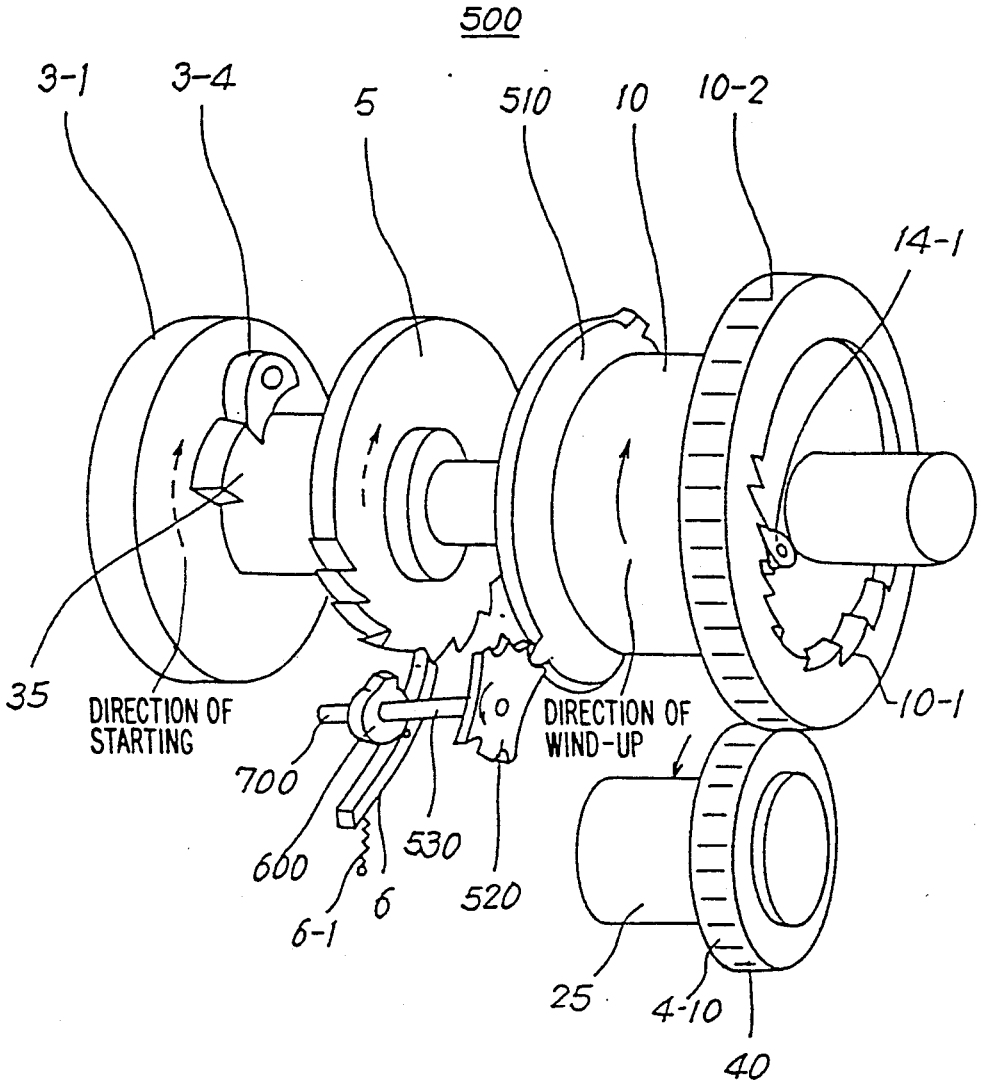
FIG. 27 is a perspective view of a one revolution converter mechanism of FIG. 26.

When the motor 25 rotates, as shown in FIG. 27, the drive gear 510 rotates in synchronism with the speed reduction mechanism 40 and the spring power accumulating chamber 10.

Upon commencement of the winding up of the spring, if the respective teeth of the drive gear 510 and the memory gear 520 are held meshed with each other and the spring power accumulating chamber 10 is thus held in the state it was in just prior to completion of wind-up, then simultaneously with depression of the switch 750 the control shaft 530 begins to rotate and completes the wind-up. Since the ON-OFF contacts 700 are put into a conducting state after rotation of a predetermined angle, even if the switch 750 is released, the motor 25 continues to operate until the insulator 711 comes to the original position.

Immediately after the ON-OFF contacts 700 start conducting and the wind-up has been completed, if the starting ratchet lever 6 is actuated by the cam 600, then as the shaft 12 becomes free to rotate, strain energy of distortion accumulated in the spiral spring 11 is released to drive the starter ratchet wheel 4, and thereby the engine is started.

After a predetermined period after the engine has been started the cam 600 engages the starting ratchet lever 6 with the starting ratchet wheel 5, so as to stop rotation of the starting ratchet wheel 5. Then power accumulation in the spiral spring 11 by the motor 25 is commenced, and it continues until the conduction through the ON-OFF contacts 700 is interrupted just prior to completion of wind-up.

Operation timing of the above-described process is schematically indicated in FIG. 30. In this figure, the respective operations of the ON-OFF switch 750, the motor 25, the memory gear 520, the starting ratchet lever 6, the ON-OFF contacts 700 and the starter ratchet wheel 4 are schematically shown, assuming the number of wind-up revolutions to be 2.5 and taking the rotational angle of the drive gear 510 as a reference (along the abscissa).

As described above, by fixing the memory gear 520, the cam 600 and the ON-OFF contacts 700 on the control shaft 530 so that the cam 600 and the ON-OFF contacts 700 can rotate in an in-phase relationship with the memory gear 520, particular times within the period when the tooth 511 of the drive gear 510 and the tooth 521 of the memory gear 520 are meshed with each other, can be designated on the control shaft 530 as the time of completion of wind-up and as the time of just prior to completion of wind-up.

In addition, by presetting the initial condition at the time prior to the timing of completion of wind-up, the time when the cam 600 releases the starting ratchet lever 6, and the time when the ON-OFF contacts 700 and the ON-OFF switch 750 open and close the motor power supply circuit can be allotted on the operation diagram in FIG. 30. Thus, a cycle is carried out such that when the ON-OFF switch 750 is depressed, the motor 25 rotates and completes wind-up. During that period the ratchet lever 6 is released, and after the engine 1 has been started, wind-up is commenced and just before completion of the wind-up, the starting apparatus is placed in a standby state.

The power supply 800 in FIG. 29 can be either a power supply of an ignition system or a separate power supply. With regard to a grounding circuit, another sheet conductor can be provided in addition to the sheet conductor 720 to form a slip ring, and a ground wire can be provided.

According to the last-described preferred embodiment, in a spiral spring power accumulator device consisting of a shaft, a casing rotatably supported about the shaft and a spiral spring having its opposite ends fixedly secured to the shaft and the casing, respectively, a ratchet mechanism for controlling rotation and stoppage of the shaft, and a drive power source consisting of a motor for rotationally driving the casing and a speed reduction mechanism, there are provided a converter mechanism for converting a particular rotational angle of the casing into one revolution by means of a gear rotating integrally with the casing and another gear meshed with the aforementioned gear, a cam and a rotary ON-OFF contact provided on an output shaft of the converter mechanism so as to be rotatable integrally with the output shaft, and a manual ON-OFF switch. By operating the manual ON-OFF switch, after starting of the engine was effected, energy accumulation in the power accumulation device can be effected automatically and the starter apparatus is placed in a standby state. In this manner various advantages are realized. For example, the electric control circuit for operation and stoppage of the motor serving as a power source for the spring power accumulating chamber is simplified. Also, since it becomes possible to operate the starting ratchet lever by making use of the same motor in common, remote control starting operation becomes possible. Additionally since completion of wind-up of the spiral spring is detected on the basis of the number of revolutions of wind-up, a stable output of the spiral spring can always be obtained and thus the starting characteristics can be improved.

Figure 31:
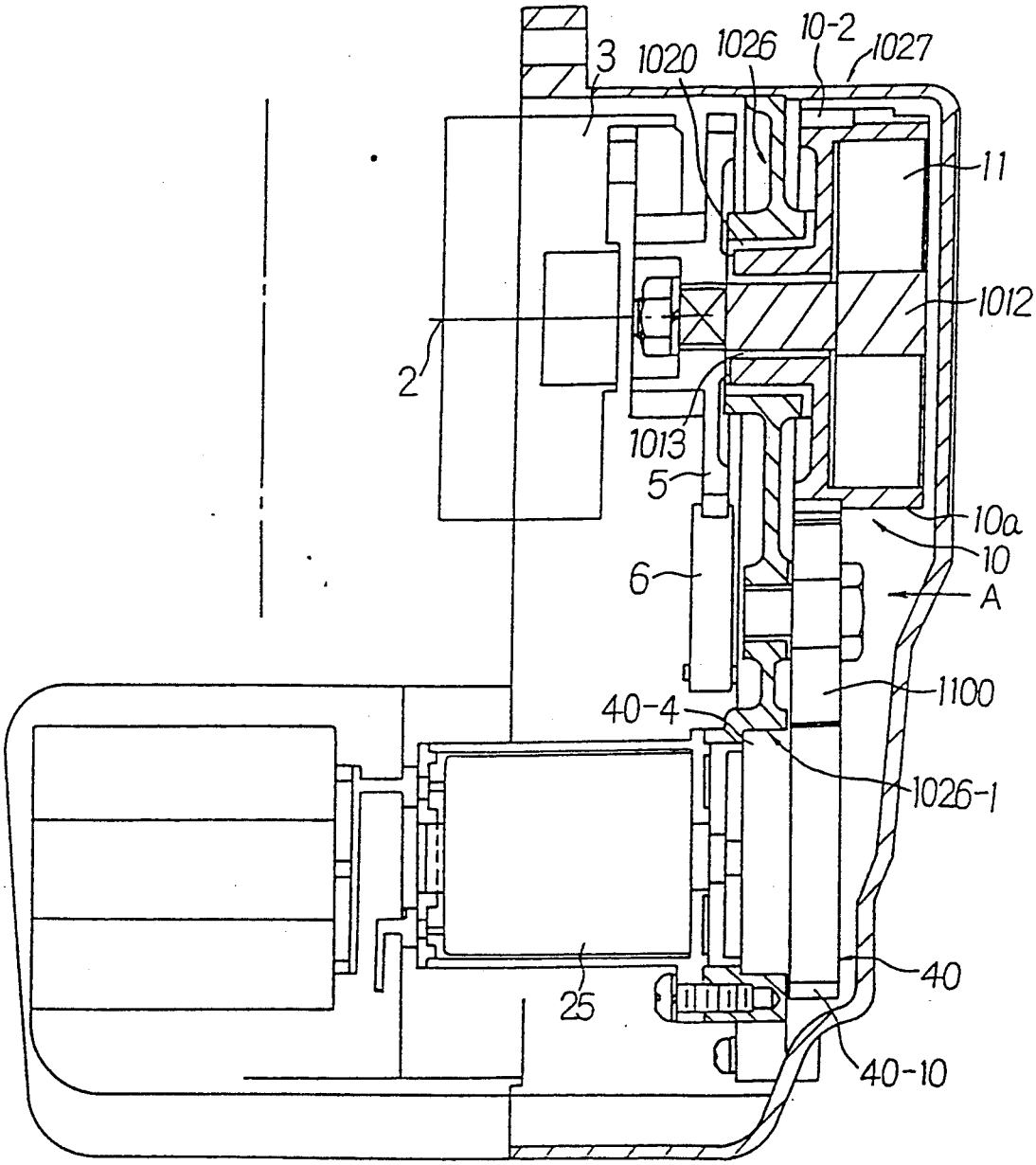
FIG. 31 is a partial longitudinal cross-section view of a spiral spring type starter apparatus according to a further preferred embodiment of the present invention.
Figure 32:
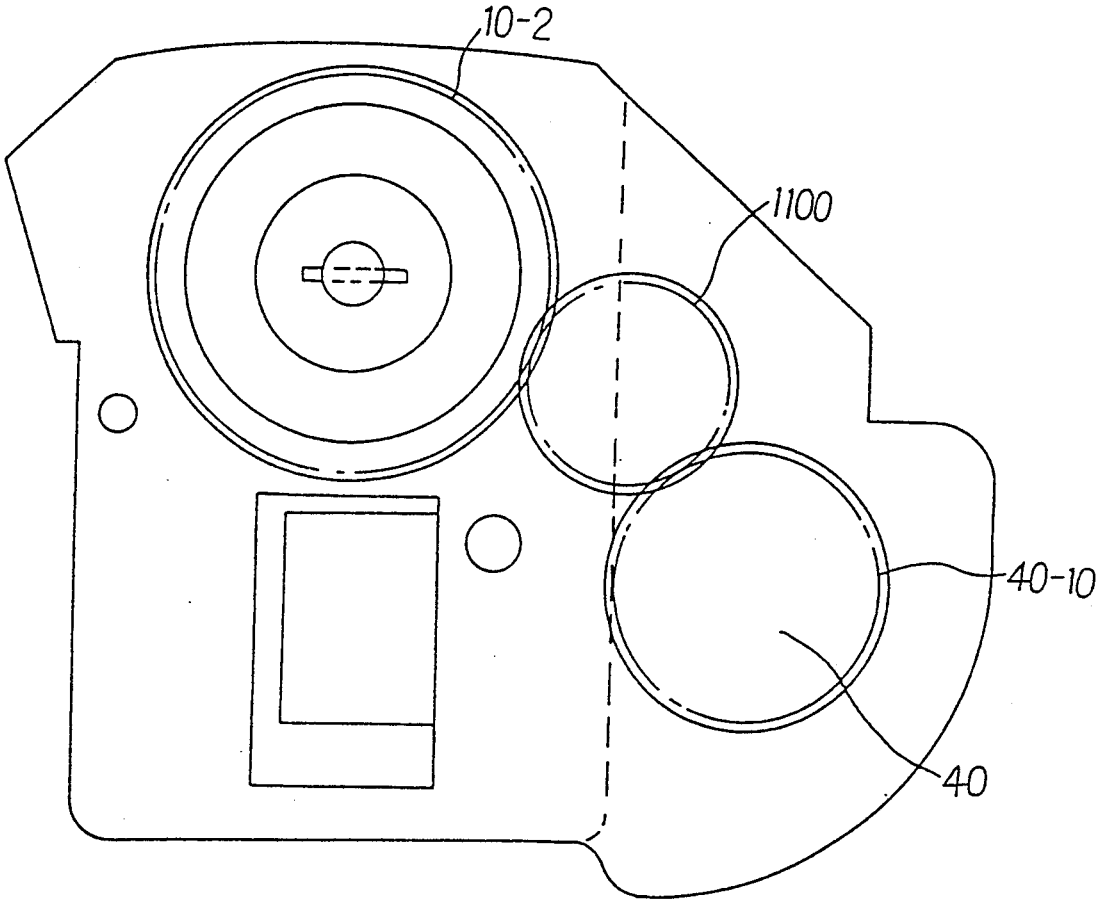
FIG. 32 is a schematic partial view as viewed in the direction of arrow A in FIG. 31.
Figure 33:
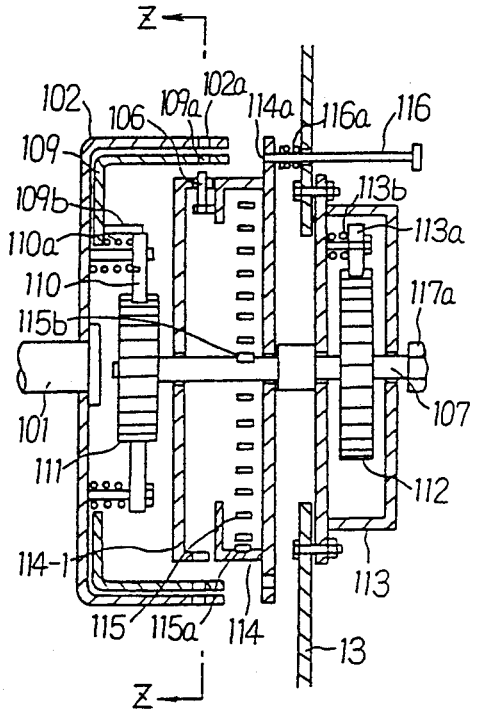
FIG. 33 (PRIOR ART)
FIG. 33 is a longitudinal cross-section view of a spiral spring type starter apparatus for an internal combustion engine in the prior art, which was disclosed in Laid-Open Japanese Patent Specification No. 58-51271 (1983)
Figure 34:
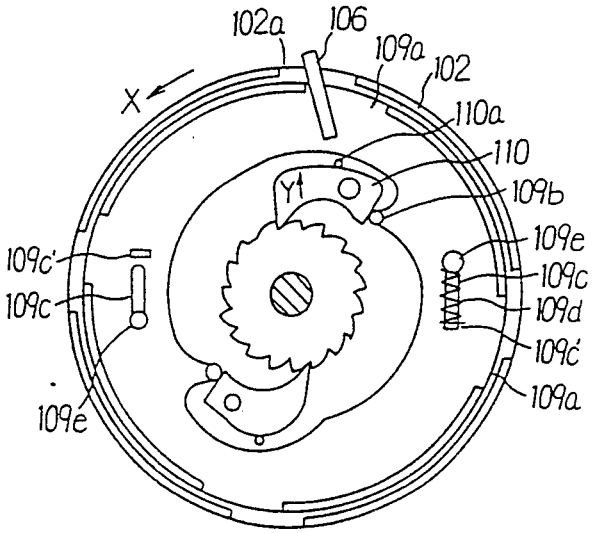
FIG. 34 (PRIOR ART)
FIG. 34 is a cross-section view taken along line Z—Z in FIG. 33.

Still further, FIGS. 31 and 32 show yet another preferred embodiment which has an object, ease of assembly and compactness in structure of the starting apparatus.

In FIGS. 31 and 32, reference numeral 5 designates a ratchet wheel, numeral 6 designates a starting ratchet lever, numeral 10 designates a spring power accumulating chamber, numeral 10*a* designates a casing, numeral 11 designates a spiral spring, numeral 25 designates a motor, numeral 40 designates a high reduction ratio speed reduction mechanism, numeral 1012 designates a starter shaft, numeral 1013 designates a tubular bearing for the starter shaft 1012, numeral 1020 designates a bearing for the spring power accumulating chamber 10, numeral 1026 designates a plate, numeral 1026-1 designates a spigot joint section of a fixed inner gear 40-4, numeral 1027 designates a case, and numeral 1100 designates an idler gear.

In such an apparatus, the motor 25 is mounted to the plate 1026, the fixed inner gear 40-4 of the high reduction ratio speed reduction mechanism 40 is mounted to the spigot joint section 1026-1 on the same axis as the motor 25, and motor output is transmitted to the high reduction ratio speed reduction mechanism 40.

The output of the high reduction ratio speed reduction mechanism 40 rotates the spring power accumulating chamber 10 via the idler gear 1100, and power is accumulated in the spiral spring 11.

At this moment, the ratchet wheel 5 is locked by the starting ratchet lever 6.

By releasing the starting ratchet lever 6, the ratchet wheel 5 is rotated.

At this time, since the spring power accumulating chamber 10 cannot rotate in reverse due to the high reduction ratio speed reduction mechanism 40, the starter 1012 rotates about the axis determined by the bearing 1013.

It is to be noted that owing to the idler gear 1100, the position of the high reduction ratio speed reduction mechanism 40, that is, the mount position of the motor 25, is preset at a position entering to the engine side from the starter mount surface, and the amount of protrusion of the starter from the engine is determined by the position of the power accumulating chamber 10.

In addition, the plate 1026 is mounted to the case 1027 to form a starter assembly, and by mounting this case 1027 to the engine, an engine assembly is formed.

As described above, the spiral spring type starter apparatus has, assembled in a case of an internal combustion engine, a spring power accumulating chamber in which an inner end of a spiral spring is fixed to a starter shaft and its outer end is fixed to a casing, a motor for rotating a casing of the above-mentioned spring power accumulating chamber via a high reduction ratio speed reduction mechanism, and a magnet assembly for transmitting a torque of the starter shaft of the above-mentioned spring power accumulating chamber. Within the above-mentioned case is disposed a plate perpendicularly intersecting with the axis of the crank shaft. A bearing for rotatably supporting the starter shaft projected from the casing is rotatably supported by the above-mentioned plate, and the above-mentioned motor and high reduction ratio speed reduction mechanism are fixed by the aforementioned plate. In this manner, various advantages are obtained. For example, since the spiral spring type starter apparatus, the ratchet mechanism and the mechanical power source are integrally mounted to the plate 1026, assembly becomes easy. Also, machining accuracy for an axis of a shaft is improved and a power transmission efficiency is enhanced. Additionally, because of this arrangement the idler gear 1100, the motor 25 and the high reduction ratio speed reduction mechanism 40 can be arranged at the most appropriate position in view of the design of the starter. By using an overhang double bearing, the amount of protrusion of the starter apparatus is greatly reduced and the space required can be reduced.

Since many changes and modifications can be made to the above-described construction without departing from the spirit of the present invention, it is intended that all matter contained in the above description and illustrated in the accompanying drawings shall be interpreted to be illustrative and not limiting.

What is claimed is:

1. A spiral spring type starter apparatus for an internal combustion engine, comprising:

a spiral spring power accumulator device including a shaft, a casing rotatably supported about the shaft and a spiral spring having its opposite ends fixedly secured to the shaft and the casing, respectively;

a ratchet mechanism for controlling rotation and stoppage of said shaft;

a drive power source including a motor for rotationally driving the casing and a speed reduction mechanism;

a converter mechanism for converting a particular rotational angle of the casing into one revolution by means of a gear rotating integrally with the casing and another gear member with said gear, said converter mechanism including a control output shaft;

a cam and a rotary ON-OFF contact provided on said control output shaft of said converter mechanism so as to be rotatable integrally therewith; and a manual ON-OFF switch;

whereby by operating the manual ON-OFF switch, after starting of the engine was effected, energy accumulation in said power accumulator device can be effected automatically and said starter apparatus is placed in a standby state; and wherein said converter mechanism comprises a drive gear rotating integrally with the casing and having a plurality of teeth along its outer circumference, and a Geneva-shaped driven side memory gear having a plurality of teeth to be meshed with said drive gear.

2. A spiral spring type starter apparatus for use in starting an internal combustion engine, comprising:

a spiral spring accumulator device for accumulating power for use in starting the internal combustion engine, said accumulator device including a power shaft, a casing rotatably supported about said power shaft, and a spiral spring having a first end fixed to said power shaft and a second end fixed to said casing;

a ratchet mechanism for selectively stopping and allowing rotation of said power shaft;

a drive power source for rotating said casing;

a control output shaft;

a converter mechanism, comprising a first gear fixed for rotation with said casing, and a second gear meshed with said first gear and coupled to said control output shaft, for converting a predetermined angular rotation of said casing into one rotation of said control output shaft;

a manual ON-OFF switch for actuating said drive power source; and actuation means for causing, upon actuation of said manual ON-OFF switch, said ratchet mechanism to allow rotation of said power shaft, said drive power source to be automatically subsequently actuated to rotate said casing in order to wind up said spiral spring and accumulate a predetermined amount of power, and said power accumulator device to, in turn, be automatically placed in a standby condition in which said power accumulator device maintains said predetermined amount of power for subsequent use.

3. A spiral spring type starter apparatus as recited in claim 2, wherein said actuation means comprises a cam element fixed for rotation with said control output shaft and being engageable with said ratchet mechanism to cause said ratchet mechanism to allow rotation of said power shaft, and an ON-OFF contact means for maintaining activation of said drive power source once said ON-OFF switch has been released and until said predetermined amount of power has been accumulated by said power accumulator device.

4. A spiral spring type starter apparatus as recited in claim 3, wherein said ON-OFF contact means comprises an annular conductor, having a slit-shaped insulating portion, mounted about and fixed for rotation with said control output shaft, and a sheet conductor in engagement with said annular conductor.

5. A spiral spring type starter apparatus as recited in claim 2, wherein said first gear of said converter mechanism comprises a drive gear having a plurality of external teeth, and said second gear of said converter mechanism comprises a Geneva-shaped memory gear having a plurality of teeth meshed with said plurality of teeth of said drive gear.

6. A spiral spring type starter apparatus as recited in claim 5, wherein said memory gear is fixed for rotation with said control output shaft.

7. A spiral spring type starter apparatus as recited in claim 6, wherein said actuation means comprises a cam element fixed for rotation with said control output shaft and being engageable with said ratchet mechanism to cause said ratchet mechanism to allow rotation of said power shaft, and an ON-OFF contact means for maintaining activation of said drive power source once said ON-OFF switch has been released and until said predetermined amount of power has been accumulated by said power accumulator device.

8. A spiral spring type starter apparatus as recited in claim 7, wherein said ON-OFF contact means comprises an annular conductor, having a slit-shaped insulating portion, mounted about and fixed for rotation with said control output shaft, and a sheet conductor in engagement with said annular conductor.

9. A spiral spring type starter apparatus as recited in claim 2, wherein said drive power source includes a drive motor and a speed reduction mechanism.

* * * * *